US010635011B2

(12) United States Patent
Umeda et al.

(10) Patent No.: US 10,635,011 B2
(45) Date of Patent: Apr. 28, 2020

(54) TONER

(71) Applicant: CANON KABUSHIKI KAISHA, Tokyo (JP)

(72) Inventors: Noriyoshi Umeda, Suntou-gun (JP); Tsuneyoshi Tominaga, Suntou-gun (JP); Hidekazu Fumita, Gotemba (JP); Taiji Katsura, Suntou-gun (JP); Shinsuke Mochizuki, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/392,990

(22) Filed: Apr. 24, 2019

(65) Prior Publication Data

US 2019/0332024 A1 Oct. 31, 2019

(30) Foreign Application Priority Data

Apr. 27, 2018 (JP) ..... 2018-086035
Feb. 26, 2019 (JP) ..... 2019-032501

(51) Int. Cl.

| | |
|---|---|
| ***G03G 9/097*** | (2006.01) |
| ***G03G 9/087*** | (2006.01) |
| ***G03G 9/08*** | (2006.01) |
| ***G03G 9/09*** | (2006.01) |

(52) U.S. Cl.

CPC ..... *G03G 9/08782* (2013.01); *G03G 9/0806* (2013.01); *G03G 9/0819* (2013.01); *G03G 9/0821* (2013.01); *G03G 9/0825* (2013.01); *G03G 9/08711* (2013.01); *G03G 9/09* (2013.01)

(58) Field of Classification Search

CPC ..... G03G 9/08782; G03G 9/09708; G03G 9/0825

USPC ..... 430/110.1, 108.6, 108.4

See application file for complete search history.

(56) References Cited

U.S. PATENT DOCUMENTS

| | | | |
|---|---|---|---|
| 6,627,374 | B2 | 9/2003 | Fumita et al. |
| 6,835,521 | B2 | 12/2004 | Tsuji et al. |
| 6,951,704 | B2 | 10/2005 | Tsuji et al. |
| 7,135,263 | B2 | 11/2006 | Kawakami et al. |
| 7,611,813 | B2 | 11/2009 | Ida et al. |
| 7,611,816 | B2 | 11/2009 | Tsuji et al. |
| 7,767,370 | B2 | 8/2010 | Ishigami et al. |
| 8,114,562 | B2 | 2/2012 | Ishigami et al. |
| 8,372,573 | B2 | 2/2013 | Ayaki et al. |
| 8,383,313 | B2 | 2/2013 | Ayaki et al. |
| 8,545,133 | B2 | 10/2013 | Fumita et al. |
| 8,551,680 | B2 | 10/2013 | Ayaki et al. |
| 8,916,319 | B2 | 12/2014 | Ikeda et al. |
| 8,940,467 | B2 | 1/2015 | Hashimoto et al. |
| 9,261,806 | B2 | 2/2016 | Moribe et al. |
| 9,285,697 | B2 | 3/2016 | Fukudome et al. |
| 9,366,981 | B2 | 6/2016 | Yamawaki et al. |
| 9,423,708 | B2 | 8/2016 | Tominaga et al. |
| 9,632,441 | B2 | 4/2017 | Abe et al. |
| 9,720,340 | B2 | 8/2017 | Tominaga et al. |
| 9,733,583 | B2 | 8/2017 | Kuroki et al. |
| 9,733,584 | B2 | 8/2017 | Masumoto et al. |
| 9,785,068 | B2 | 10/2017 | Umeda et al. |
| 9,785,077 | B2 | 10/2017 | Abe et al. |
| 9,829,820 | B2 | 11/2017 | Masumoto et al. |
| 9,897,932 | B2 | 2/2018 | Hotta et al. |
| 9,921,501 | B2 | 3/2018 | Mochizuki et al. |
| 10,054,866 | B2 | 8/2018 | Tanaka et al. |
| 10,078,279 | B2 | 9/2018 | Nakagawa et al. |
| 10,114,303 | B2 | 10/2018 | Katsura et al. |
| 10,303,074 | B2 | 5/2019 | Yamawaki et al. |
| 2011/0045395 | A1 | 2/2011 | Fujiwara et al. |
| 2015/0248072 | A1 | 9/2015 | Katsuta et al. |
| 2017/0160658 | A1 | 6/2017 | Nakagawa et al. |
| 2018/0246430 | A1* | 8/2018 | Tanaka ..... G03G 9/09716 |
| 2018/0246432 | A1* | 8/2018 | Nishikawa ..... G03G 9/08797 |
| 2018/0329320 | A1 | 11/2018 | Yoshida et al. |
| 2018/0329332 | A1 | 11/2018 | Tominaga et al. |

FOREIGN PATENT DOCUMENTS

| | | |
|---|---|---|
| EP | 1 515 196 | 3/2005 |
| JP | 2008-058463 | 3/2008 |
| JP | 2011-043696 | 3/2011 |
| JP | 2016-070986 | 5/2016 |
| JP | 2017-102399 | 6/2017 |

OTHER PUBLICATIONS

U.S. Appl. No. 16/377,549, Kentaro Yamawaki, filed Apr. 8, 2019.

* cited by examiner

*Primary Examiner* — Christopher D Rodee
(74) *Attorney, Agent, or Firm* — Venable LLP

(57) ABSTRACT

A toner comprising a toner particle having a binder resin, a wax and a colorant, and metal titanate fine particles having a perovskite crystal structure, wherein in cross section observation of the toner using a transmission electron microscope, when a proportion of an area occupied by the wax in a surface layer region from the surface of the toner particle to a depth of 1.0 μm is denoted by As, the As is from 5.0% to 30.0%, and a number average particle diameter of primary particles of the metal titanate fine particles is from 10 nm to 80 nm.

5 Claims, 2 Drawing Sheets

TONER

BACKGROUND OF THE INVENTION

Field of the Invention

The present invention relates to a toner for developing an electrostatic image.

Description of the Related Art

A method of visualizing image information via an electrostatic latent image, such as an electrophotographic method, is currently used in various fields, and improvement of performance including improvement of image quality and increase of speed is required.

Increasing the speed of a copying machine or a printer means that each system of developing, transferring and fixing is speeded up. Among these systems, in order to increase the speed of the fixing system, low-temperature fixability and separability (in particular, an image with a small leading margin) of a recording medium (hereinafter also referred to as paper) are required.

Attempts have been made to improve the outmigration of wax by controlling the dispersion state of the wax in a toner particle in order to achieve low-temperature fixability and separability of paper.

Japanese Patent Application Publication No. 2011-43696 discloses a method of dispersing wax in a toner particle using a styrene/acrylic binder in an emulsion aggregation method which is a method of producing a toner in an aqueous medium.

Japanese Patent Application Publication No. 2016-70986 discloses a toner in which wax is dispersed in a toner particle and the distribution state thereof is not uniform, with a larger amount of the wax being present in the vicinity of the surface layer. In this method, since the wax easily outmigrates to the toner particle surface, the releasability is improved, so that separation of the recording medium can be expected to be improved at the time of fixing.

In Japanese Patent Application Publication No. 2017-102399, the distribution of the amount of wax present in the toner particle is set to a specific range in the toner particle surface layer region, and the ratio of the amounts of wax present in the surface layer region and other regions is set to a specific range. This makes it easy for the wax to outmigrate at the time of fixing, and it is possible to improve separability between the paper and a fixing member while maintaining a state in which the low-temperature fixability is satisfactory.

SUMMARY OF THE INVENTION

However, it was found that in the methods disclosed in Japanese Patent Application Publication No. 2011-43696, Japanese Patent Application Publication No. 2016-70986 and Japanese Patent Application Publication No. 2017-102399, a problem (referred to as paper ejection defects) occurring when the printing speed is increased and continuous printing is performed is that the toner melted at the time of fixing is not instantly solidified causing the paper sheets to stick together, or that the paper is stained with the toner.

This problem occurs because the next paper sheet overlaps the toner in a molten state, that is, before the toner present on the paper after fixation solidifies. In particular, it is conceivable that that paper ejection defects are more likely to occur in the case of continuous printing when a load of overlapped paper is applied.

To cope with such a problem, it is also possible to increase the viscosity of the molten toner after fixing by coating the surface of the toner particle with an external additive such as silica particles or titanium oxide particles. However, since the viscosity increases but the solidification speed does not rise, paper ejection defects occur in high-speed printing.

As described above, there has not yet been obtained a toner capable of suppressing paper ejection defects while improving low-temperature fixability and separability between paper and a fixing member as a result of controlling the presence state of the wax.

The present invention provides a toner which solves the above-mentioned problems also in a high-speed machine. Thus, the present invention provides a toner in which the control of the presence state of wax facilitates the outmigration of the wax and improves the low-temperature fixability and separability between paper and a fixing member, and also causes instant solidification of the molten toner in the fixed image, thereby making paper ejection defects unlikely to occur.

A toner of the present invention includes a toner particle having a binder resin, a wax and a colorant, and metal titanate fine particles having a perovskite crystal structure, wherein in cross section observation of the toner using a transmission electron microscope, when a proportion of an area occupied by the wax in a surface layer region from the surface of the toner particle to a depth of 1.0 μm is denoted by As, the As is from 5.0% to 30.0%, and a number average particle diameter of primary particles of the metal titanate fine particles is from 10 nm to 80 nm.

According to the present invention, it is possible to provide a toner which is excellent in low-temperature fixability, separability between paper and a fixing member, and in which paper ejection defects are unlikely to occur.

Further features of the present invention will become apparent from the following description of exemplary embodiments with reference to the attached drawing.

DESCRIPTION OF THE EMBODIMENTS

Figure 1:
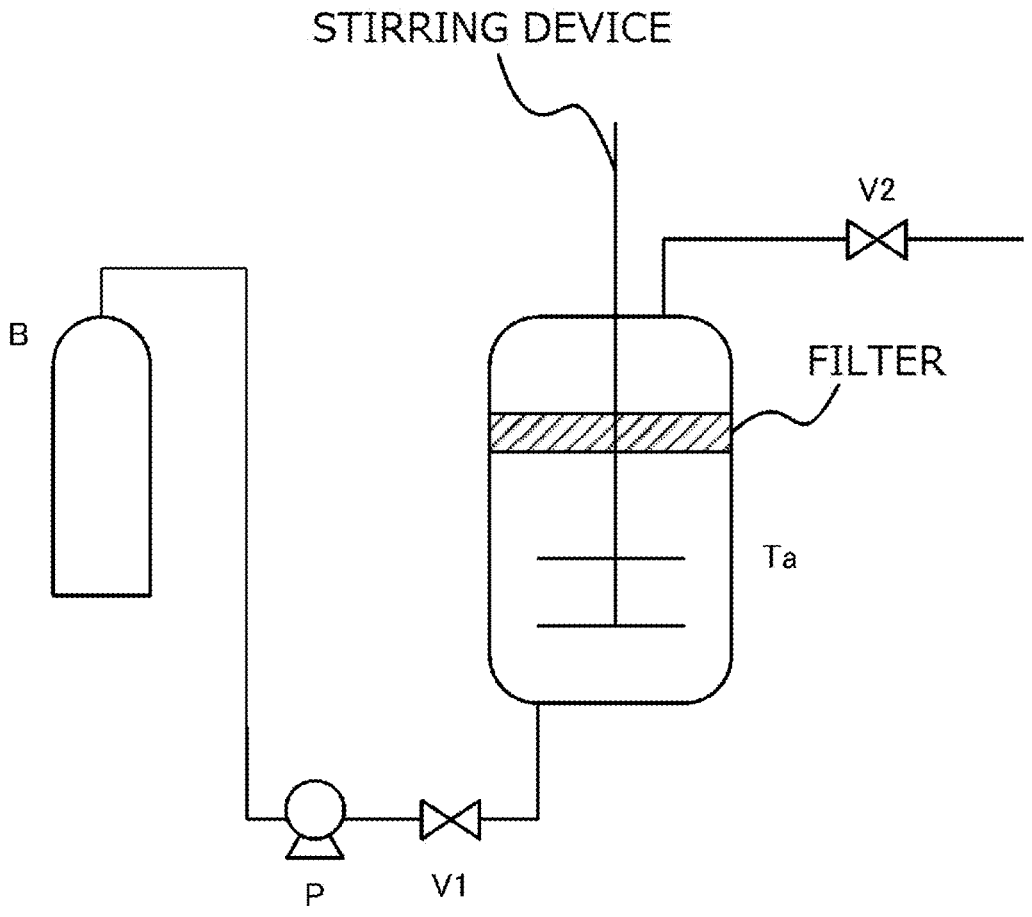
FIG. 1 shows an example of a processing apparatus used for carbon dioxide treatment.
Figure 2:
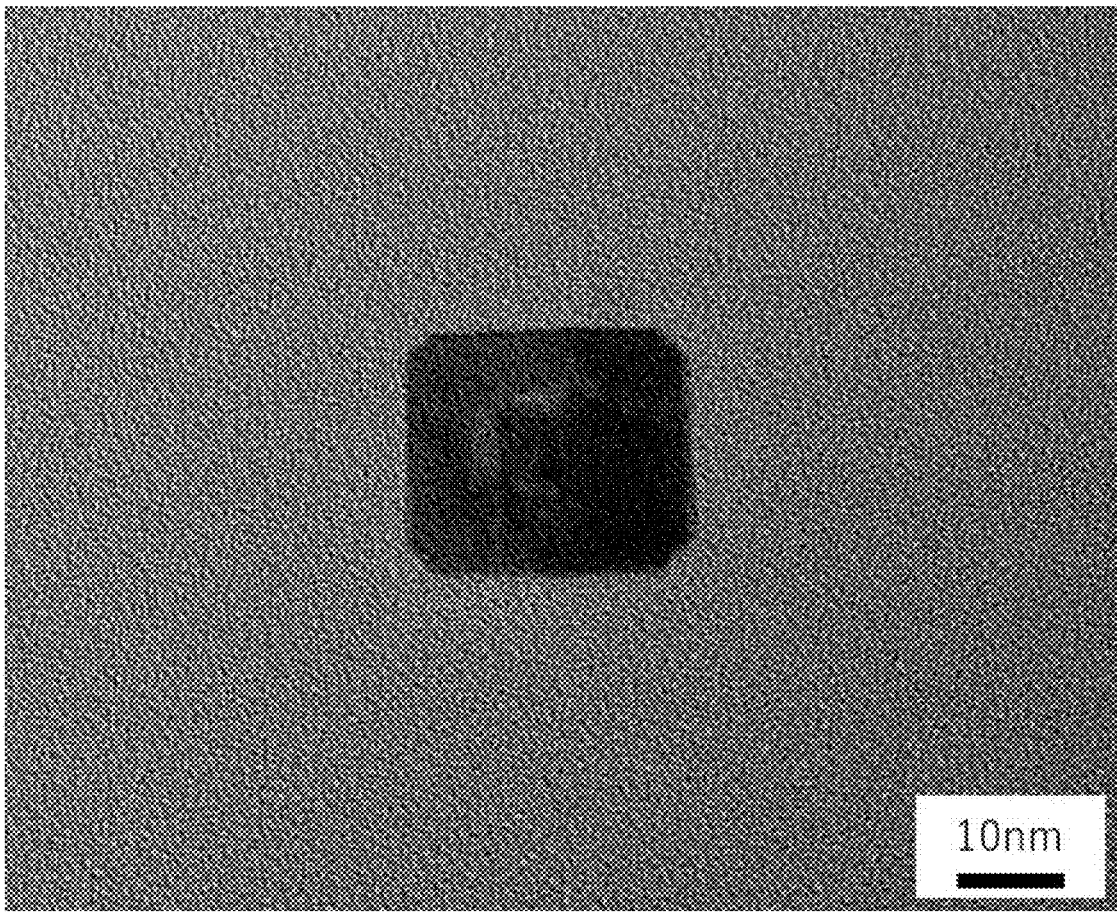
FIG. 2 is a transmission electron micrograph of strontium titanate fine particles T1.

In the present invention, the expression "from XX to YY" or "XX to YY" representing the numerical range means a numerical range including a lower limit and an upper limit which are endpoints unless otherwise specified.

Hereinafter, the present invention will be described in detail.

By satisfying the above conditions, it is possible to obtain a toner which is excellent in low-temperature fixability and separability of paper at the time of fixing and in which paper ejection defects are less likely to occur in a high-speed printing system. Although the reasons therefor are not clear, the inventors of the present invention have considered the following.

When low-temperature fixability and paper separability at the time of fixing are considered, in order to adapt to a high-speed printing system, a large amount of wax is needed in the vicinity of the toner particle surface. However, since the binder resin and the wax are made compatible with each other by heat at the time of fixing, the toner is unlikely to solidify instantly from the molten state thereof, and paper ejection defects occur. Meanwhile, when perovskite crystal particles are used as an external additive, these particles act as crystal nuclei and can promote the crystallization of the wax compatibilized with the binder resin. As a result, the toner instantly solidifies after fixing, and paper ejection defects are unlikely to occur even in high-speed printing.

The toner of the present invention includes a toner particle having a binder resin, a wax and a colorant, and metal titanate fine particles having a perovskite crystal structure, wherein in cross section observation of the toner using a transmission electron microscope, when a proportion of an area occupied by the wax in a surface layer region from the surface of the toner particle to a depth of 1.0 μm is denoted by As, the As is from 5.0% to 30.0%, and a number average particle diameter of primary particles of the metal titanate fine particles is from 10 nm to 80 nm.

The distribution state of the wax can be confirmed by observing the cross section of the toner. In this case, a state is preferable in which a plurality of domains showing the wax are observed in the surface layer region having a depth of 1.0 μm from the toner particle surface. In this state of the wax, better paper separability is achieved.

Also, in the cross section observation of the toner using a transmission electron microscope, when a proportion of the area occupied by the wax in the surface layer region from the surface of the toner particle to the depth of 1.0 μm is denoted by As, the As is from 5.0% to 30.0%. When As falls within this range, satisfactory paper separability is obtained due to increased outmigration of the wax. The preferable range of As is from 7.0% to 20.0%.

When As is less than 5.0%, the wax is unlikely to out-migrate at the time of fixing, so that paper separability at the time of fixing tends to degrade.

Meanwhile, when As exceeds 30.0%, since the wax presence ratio in the vicinity of the toner particle surface is large, cracking and chipping of the toner particle are likely to occur in high-speed development, and development stripes tend to occur at the time of durability printing.

As can be controlled by the type of wax to be used, production conditions at the time of production of the toner particle, and the like.

For example, in the case of a suspension polymerization method in which a composition including polymerizable monomers is granulated in an aqueous medium to produce the toner particle, As can be controlled by conditions of a cooling step after the polymerization step and a crystallization step of the wax. Specifically, the wax is dispersed throughout the resin by increasing the cooling rate in the temperature range from the melting point of the wax to the glass transition temperature (Tg) of the toner particle. Thereafter, the value of As is increased by heating at a temperature close to the melting point of the wax in order to promote the crystallization of the wax.

Further, in order to increase the value of As, control can be performed by the conditions of the carbon dioxide treatment step and the like. For example, the value of As is increased as the temperature of carbon dioxide is increased, the pressure is increased, or the processing time is increased.

In the present invention, metal titanate fine particles having a perovskite crystal structure are used as an external additive for instantly solidifying the molten toner after fixing. It is preferable to have the metal titanate fine particles on the toner particle surface. It is conceivable that the metal titanate fine particles having a perovskite crystal structure can act as crystal nuclei and promote the crystallization of the wax compatible with the binder resin.

It is essential that the number average particle diameter of the primary particles of the metal titanate fine particles be from 10 nm to 80 nm. By adopting this range, metal titanate fine particles are present in a state of being uniformly adhered to the toner particle surface. Accordingly, even when there are few metal titanate fine particles on the toner particle, it is conceivable that the metal titanate fine particles are likely to be dispersed in the toner melted at the time of fixing, thereby promoting the crystallization of the wax.

The number average particle diameter of the primary particles of the metal titanate fine particles is preferably from 10 nm to 60 nm.

The metal titanate fine particles have a perovskite crystal structure and have a cubic/rectangular parallelepiped shape. As a result, the metal titanate fine particles are supported by the flat surface portion thereof at the time of fixing and are unlikely to sink into the molten toner. As a result, it is conceivable that it is possible to promote the crystallization of the wax at the surface portion of the fixed image, thereby further suppressing the paper ejection defects.

When the number average particle diameter of the primary particles of the metal titanate fine particles is less than 10 nm, stable production thereof becomes difficult. In addition, since the metal titanate fine particles tend to sink into the molten toner, the crystallization of the wax at the surface portion of the fixed image is delayed, and adhesion of ejected paper tends to occur.

Meanwhile, when the number average particle diameter of the primary particles of the metal titanate fine particles is larger than 80 nm, the adhesion to the toner particle becomes nonuniform at the time of external addition, and the dispersibility in the molten toner after fixing is lowered. As a result, since the crystallization ability is reduced, paper ejection defects are likely to occur.

As the metal titanate fine particles having a perovskite crystal structure, fine particles of at least one type selected from the group consisting of beryllium titanate fine particles, magnesium titanate fine particles, calcium titanate fine particles, strontium titanate fine particles, barium titanate fine particles and the like can be used.

The metal titanate fine particles preferably include strontium titanate fine particles, and more preferably are strontium titanate fine particles.

It is preferable that the metal titanate fine particles include strontium titanate fine particles, and in the X-ray diffraction spectrum of CuKα obtained in the range of 2θ from 10° to 90°, with θ being the Bragg angle of the strontium titanate fine particles, peaks derived from the strontium titanate fine particles are at 39.700°±0.150° and 46.200°±0.150°.

Strontium titanate having peaks at these positions adopts a perovskite structure belonging to a cubic system. The peaks at 39.700°±0.150° and 46.200°±0.150° are diffraction peaks derived from the lattice planes with Miller indices (111) and (200), respectively. Generally, particles belonging to the cubic system are likely to take a hexahedral shape as the external shape of the particles.

In the production process, strontium titanate fine particles grow while maintaining (100) and (200) planes corresponding to the plane direction of the hexahedral shape.

As a result of examination by the inventors of the present invention, it was found that satisfactory characteristics are exhibited when using strontium titanate fine particles having a (200) plane corresponding to the plane direction of the hexahedral shape and a (111) plane corresponding to the apex direction.

As a result of detailed examination, it was found that when the area of the peak at 39.700°±0.150° is denoted by Sa and the area of the peak at 46.200°±0.150° is denoted by Sb, Sb/Sa is preferably from 1.80 to 2.30, and more preferably from 1.80 to 2.25. Within this range, sinking of strontium titanate fine particles in the molten state of the toner after fixing is further suppressed and wax crystallization in the surface portion of the fixed image can be efficiently promoted.

This is conceivably because within the above range, the strontium titanate fine particles can adhere to the toner particle in a more uniformly dispersed state. It is also conceivable that wax crystallization is promoted and paper ejection defects are suppressed because the strontium titanate fine particles can be uniformly present even in the molted state of the toner after fixing.

Sb/Sa can be controlled by adjusting the mixing ratio of the titanium oxide source and the strontium source, or by implementing dry mechanical treatment.

For example, HYBRIDIZER (manufactured by Nara Machinery Co., Ltd.), NOBILTA (manufactured by Hosokawa Micron Corporation), MECHANO FUSION (manufactured by Hosokawa Micron Corporation), HIGH FLEX GRAL (manufactured by EARTHTECHNICA Co., Ltd.), and the like can be used. Sb/Sa can be controlled to from 1.80 to 2.30 by treating strontium titanate fine particles with these devices.

The metal titanate fine particles may be surface-coated with a treatment agent in order to adjust charging and improve environmental stability.

Examples of the treating agent are presented hereinbelow:

titanium coupling agents;

silane coupling agents;

silicone oils;

fatty acid metal salts such as zinc stearate, sodium stearate, calcium stearate, zinc laurate, aluminum stearate, magnesium stearate and the like; and fatty acids such as stearic acid and the like.

The treatment method can be exemplified by a wet method in which a surface treatment agent or the like is dissolved/dispersed in a solvent, metal titanate fine particles are added thereto, and the solvent is removed under stirring, and a dry method in which a coupling agent, a fatty acid metal salt and metal titanate fine particles are directly mixed and treated under stirring.

A method for producing the toner is not particularly limited, but a wet production method (suspension polymerization method, dissolution suspension method, and the like) in which the toner raw material is granulated in an aqueous medium to produce the toner particle is preferable, because a remarkable effect is obtained. As an example, a production method using a suspension polymerization method in which a composition including polymerizable monomers is granulated in an aqueous medium to produce the toner particle will be described hereinbelow step by step.

Step of Preparing Polymerizable Monomer Composition

Polymerizable monomers that form a binder resin, a wax, a colorant and the like are mixed to prepare a polymerizable monomer composition. The colorant may be mixed with other materials after being dispersed in advance in the polymerizable monomers or an organic solvent by a medium stirring mill or the like, or may be dispersed after mixing all the materials. If necessary, additives such as a polar resin, a pigment dispersant, a charge control agent and the like may be appropriately added to the polymerizable monomer composition.

Step of Dispersing Polymerizable Monomer Composition (Granulation Step)

An aqueous medium including a dispersion stabilizer is prepared and loaded into a stirring tank equipped with a stirrer having a high shear force, and the polymerizable monomer composition is added thereto and dispersed by stirring to form droplets of the polymerizable monomer composition.

Polymerization Step

The polymerizable monomers in the droplets of the polymerizable monomer composition obtained as described above are polymerized to obtain a resin particle-dispersed solution. The polymerizable monomers are polymerized to form a binder resin. For the polymerization step, a general stirring tank capable of adjusting the temperature can be used.

The polymerization temperature is usually 40° C. or more and preferably from 50° C. to 95° C. Although the polymerization temperature may be constant from the beginning, the temperature may be raised in the latter half of the polymerization step for the purpose of obtaining a desired molecular weight distribution. Any stirring blade suitable for stirring may be used as long as the blade causes the resin particle-dispersed solution to float without stagnation and keeps the temperature in the tank uniform.

Volatile Component Removal Step

In order to remove unreacted polymerizable monomers and the like from the resin particle-dispersed solution after completion of the polymerization step, a volatile component removal step may be carried out. The volatile component removal step is carried out by heating and stirring the resin particle-dispersed solution in a stirring tank equipped with a stirring means. The heating conditions during the volatile component removal step are appropriately adjusted in consideration of the vapor pressure of the component to be removed, such as the polymerizable monomers. The volatile component removal step can be carried out under normal or reduced pressure.

Cooling Step

The cooling step is preferably started at a temperature equal to or higher than the temperature (for example, melting point) at which the wax crystallizes, and cooling is performed to a temperature equal to or lower than the glass transition temperature (Tg) of the toner particle. The dispersion of the wax improves as the cooling rate rises. The cooling rate is preferably from 0.5° C./s to 10.0° C./s.

Wax Crystallization Step

If necessary, a wax crystallization step may be carried out. The wax crystallization step is carried out by heating and stirring the resin particle-dispersed solution in a stirring tank equipped with a stirring means. The heating conditions at the time of wax crystallization are appropriately adjusted in consideration of the melting point of the wax. A temperature between the glass transition temperature of the toner particle and the wax melting point is preferable. The time required for wax crystallization is preferably long. Specifically, wax crystallization is promoted by maintaining the temperature for 1 h or more. Although the upper limit is not particularly limited, the time is preferably 10 h or less.

Solid-liquid Separation Step, Washing Step and Drying Step

For the purpose of removing the dispersion stabilizer attached to the toner particle surface, the toner particle-dispersed solution may be treated with an acid or an alkali.

After the dispersion stabilizer has been removed from the toner particle, the toner particle is separated from the aqueous medium by a general solid-liquid separation method, but in order to completely remove the acid or alkali and the dispersion stabilizer components dissolved therein, it is preferable to wash the toner particle by adding water again. It is preferable that solid-liquid separation be performed again to obtain the toner particle after repeating the washing step several times and performing sufficient washing. The obtained toner particle can be dried by a known drying means.

The weight average particle diameter of the toner is preferably from 4.0 μm to 10.0 μm, and more preferably from 5.0 μm to 8.0 μm. These ranges of the weight average particle diameter of the toner are preferable because the distribution of the wax can be easily maintained in a desired state and inhibition of low-temperature fixability caused by particle diameter can also be suppressed. When the weight average particle diameter is 4 μm or more, the load on the toner particle surface during durability use can be suppressed, and development stripes are less likely to occur. The weight average particle diameter of the toner can be controlled by adjusting the amount of the dispersion stabilizer used in the granulation step and the shearing force in the granulation step.

External Addition Step

An external additive may be added to the obtained toner particle for the purpose of improving flowability, charging performance, caking resistance and the like. The external addition step is carried out, for example, by placing the external additive and the toner particle in a mixing apparatus equipped with blades rotating at high speed and sufficiently mixing.

Next, the exposure treatment step using carbon dioxide will be described. The obtained toner particle can be also subjected to exposure treatment with carbon dioxide.

Carbon Dioxide Treatment Step

The carbon dioxide treatment step includes an exposure treatment step performed with respect to either or both of (i) and (ii) below. In either case, the processing procedure is the same.

(i) the toner particle obtained after the solid-liquid separation step or after the drying step (the pretreated toner particle having the binder resin and the wax); and (ii) the toner obtained after the external addition step (pretreated toner having the binder resin, the wax and the external additive).

Hereinafter, (i) represents the pretreated toner particle and (ii) represents the pretreated toner; the toner particle (i) treated by the following steps are referred to as a post-treated toner particle and the toner (ii) treated by the following steps is referred to as a post-treated toner. In addition, when simple representation by "toner particle" or "toner" is used, the states before and after the treatment are not distinguished from each other.

The exposure treatment step using carbon dioxide includes the following exposure treatment step (A) or (B):

(A) a step of exposing the pretreated toner particle to carbon dioxide to obtain a toner particle; and (B) a step of exposing the pretreated toner to carbon dioxide to obtain a toner.

The treatment apparatus to be used for the carbon dioxide treatment is not particularly limited as long as the pressure and temperature can be adjusted to predetermined levels, but the exposure treatment method will be described below based on an example of the treatment apparatus shown in FIG. 1.

A pressurization holding tank Ta of the treatment apparatus shown in FIG. 1 includes a filter that prevents the post-treated toner particle and the post-treated toner from flowing out of the tank Ta together with the carbon dioxide when the carbon dioxide is discharged to the outside through a back pressure valve V2. In addition, the tank Ta has a stirring mechanism for mixing.

In the carbon dioxide treatment, first, the pretreated toner particle and the pretreated toner are loaded in the tank Ta adjusted to a predetermined temperature and stirred. Next, a valve V1 is opened and carbon dioxide in a compressed state is introduced by a compression pump P from a container B when the carbon dioxide is stored into the tank Ta. When the predetermined pressure is reached, the pump is stopped, the valve V1 is closed, the inside of the tank Ta is hermetically sealed, and the pressure is held for a predetermined time. When a predetermined holding time has elapsed, the valve V2 is released, carbon dioxide is discharged to the outside of the tank Ta, and the pressure in the tank Ta is reduced to the atmospheric pressure.

It is also possible to repeat two or more times a step of holding the pressure after introducing the carbon dioxide, bringing carbon dioxide into contact with the pretreated toner particle and the pretreated toner, and discharging carbon dioxide after the treatment.

The temperature of carbon dioxide is preferably from 10° C. to 60° C., and more preferably from 15° C. to 55° C. When the temperature is within this range, the permeated carbon dioxide easily dissolves the wax and the wax easily diffuses into the binder resin, so that the wax dispersion effect is easily obtained. It is thus possible to obtain excellent low-temperature fixability. In addition, when the temperature is within this range, it is possible to suppress fusion of the post-treated toner particle and the post-treated toner.

The pressure of carbon dioxide is preferably from 1.0 MPa to 3.5 MPa, and more preferably from 1.5 MPa to 3.0 MPa. When the pressure is within this range, carbon dioxide sufficiently permeates into the toner particle or the toner, making it easy for the carbon dioxide to reach the wax inside the toner particle or the toner. A wax dispersion effect is thus easily obtained, and excellent low-temperature fixability can be obtained. Further, when the pressure is within this range, it is possible to suppress fusion of the post-treated toner particle and the post-treated toner.

Carbon dioxide may be used singly or in combination with other gases. When mixed with other gases, the partial pressure of carbon dioxide is preferably from 1.0 MPa to 3.5 MPa.

The time of the carbon dioxide treatment step (exposure treatment step) is preferably 5 min or more, and more preferably 30 min or more. By carrying out the treatment for 5 min or more, the wax can sufficiently diffuse into the binder resin, and a suitable distribution of the wax can be obtained. From the viewpoint of controlling the amount of wax present in the vicinity of the surface layer of the post-treated toner particle and the post-treated toner and maintaining satisfactory charging performance and durability, the duration of the carbon dioxide treatment step is preferably 180 min or less, and more preferably 150 min or less.

By the exposure treatment with carbon dioxide, the distribution state of the wax in the toner particle can be controlled. By realizing suitable temperature, pressure and contact time of carbon dioxide, the desired distribution state of the wax in the toner particle can be obtained.

Materials that can be used for the toner particle will be specifically described hereinbelow by way of example, but these examples are not limiting.

A known resin can be used as the binder resin.

Specific examples thereof include vinyl resins; polyester resins; polyamide resins; furan resins; epoxy resins; xylene resins; and silicone resins. These resins can be used singly or in a mixture.

Homopolymers or copolymers of the following monomers can be used as the vinyl resins. For example, styrene monomers typified by styrene, α-methylstyrene, divinylbenzene and the like; unsaturated carboxylic acid esters typified by methyl acrylate, butyl acrylate, methyl methacrylate, 2-hydroxyethyl methacrylate, t-butyl methacrylate, 2-ethylhexyl methacrylate and the like; unsaturated carboxylic acids typified by acrylic acid, methacrylic acid and the like; unsaturated dicarboxylic acids typified by maleic acid and the like; unsaturated carboxylic acid anhydrides typified by maleic anhydride and the like; and nitrile type vinyl monomers typified by acrylonitrile and the like.

A styrene acrylic resin produced from a styrene monomer and an acrylic monomer (an unsaturated carboxylic acid ester and/or an unsaturated carboxylic acid) is preferable from the viewpoint of developing characteristics and durability of the toner. The ratio of the styrene monomer to the acrylic monomer may be adjusted in consideration of the desired glass transition temperature of the binder resin and the toner particle. The amount of the styrene acrylic resin in the binder resin is preferably from 50% by mass to 100% by mass, and more preferably from 80% by mass to 100% by mass.

Well-known polymerization initiators such as peroxide type polymerization initiators, azo type polymerization initiators and the like can be used without a particular limitation in the production of the binder resin and toner particle.

Examples of the peroxide type polymerization initiator that can be used include organic systems such as peroxyesters, peroxydicarbonates, dialkyl peroxides, peroxyketals, ketone peroxides, hydroperoxides, and diacyl peroxides.

Examples of the inorganic system include persulfates, hydrogen peroxide, and the like. Specific examples include peroxyesters such as t-butyl peroxyacetate, t-butyl peroxypivalate, t-butyl peroxyisobutyrate, t-hexyl peroxyacetate, t-hexyl peroxypivalate, t-hexyl peroxyisobutyrate, t-butyl peroxyisopropyl monocarbonate, t-butyl peroxy 2-ethylhexyl monocarbonate and the like; diacyl peroxides such as benzoyl peroxide and the like; peroxydicarbonates such as diisopropyl peroxydicarbonate and the like; peroxyketals such as 1,1-di-t-hexylperoxycyclohexane and the like; dialkyl peroxides such as di-t-butyl peroxide and the like; and t-butyl peroxyallyl monocarbonates and the like.

Examples of suitable azo type polymerization initiators include 2,2'-azobis-(2,4-dimethylvaleronitrile), 2,2'-azobisisobutyronitrile, 1,1'-azobis (cyclohexane-1-carbonitrile), 2,2'-azobis-4-methoxy-2,4-dimethylvaleronitrile, azobisisobutyronitrile, dimethyl-2,2'-azobis(2-methylpropionate) and the like.

If necessary, two or more of these polymerization initiators can also be used at the same time. The amount of the polymerization initiator used in this case is preferably from 0.10 parts by mass to 20.0 parts by mass with respect to 100.0 parts by mass of the polymerizable monomers.

The acid value of the binder resin is preferably from 0.0 mg KOH/g to 15.0 mg KOH/g, and more preferably from 0.0 mg KOH/g to 8.0 mg KOH/g. When the acid value is 15.0 mg KOH/g or less, carbon dioxide easily permeates into the binder resin, and the wax dispersion effect is easily obtained.

The weight average molecular weight (Mw) of the binder resin is preferably from 10,000 to 50,000, and more preferably from 12,000 to 45,000. When the weight average molecular weight is 10,000 or more, the binder resin and the wax in the post-treated toner particle and the post-treated treated toner are likely to maintain the phase separation state, and the wax easily out-migrates at the time of fixing. As a result, low-temperature fixability is improved. Further, when the weight average molecular weight is 50,000 or less, carbon dioxide easily permeates into the binder resin, and a sufficient wax dispersion effect can be obtained.

It is also possible to use a resin obtained by polymerizing the following vinyl polymerizable monomer capable of radical polymerization as the binder resin. Such a polymerizable monomer is preferable in the suspension polymerization method. As the vinyl polymerizable monomer, a monofunctional polymerizable monomer or a polyfunctional polymerizable monomer can be used. The monofunctional polymerizable monomer has one polymerizable unsaturated group, and the polyfunctional polymerizable monomer has a plurality of polymerizable unsaturated groups.

Examples of the monofunctional polymerizable monomers are presented hereinbelow.

Styrene; styrene derivatives such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene and p-phenylstyrene;

acrylic polymerizable monomers such as methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate, and 2-benzoyloxyethyl acrylate;

methacrylic polymerizable monomers such as methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate, and dibutyl phosphate ethyl methacrylate.

Examples of the polyfunctional polymerizable monomer include diethylene glycol diacrylate, triethylene glycol diacrylate, tetraethylene glycol diacrylate, polyethylene glycol diacrylate, 1,6-hexanediol diacrylate, neopentyl glycol diacrylate, tripropylene glycol diacrylate, polypropylene glycol diacrylate, 2,2'-bis(4-(acryloxydiethoxy)phenyl)propane, trimethylolpropane triacrylate, tetramethylolmethane tetraacrylate, ethylene glycol dimethacrylate, diethylene glycol dimethacrylate, triethylene glycol dimethacrylate, tetraethylene glycol dimethacrylate, polyethylene glycol dimethacrylate, 1,3-butylene glycol dimethacrylate, 1,6-hexanediol dimethacrylate, neopentyl glycol dimethacrylate, polypropylene glycol dimethacrylate, 2,2'-bis(4-(methacryloxydiethoxy)phenyl)propane, 2,2'-bis(4-(methacryloxypolyethoxy)phenyl)propane, trimethylolpropane trimethacrylate, tetramethylolmethane tetramethacrylate, divinylbenzene, divinylnaphthalene, and divinyl ether.

The monofunctional polymerizable monomers may be used singly or in combination of two or more thereof, or a combination of a monofunctional polymerizable monomer and a polyfunctional polymerizable monomer, or polyfunctional polymerizable monomers can be used singly or in combination of two or more thereof. From the viewpoint of developing characteristics and durability of the toner, it is preferable that, among the polymerizable monomers, styrene or a styrene derivative be used singly or in a mixture, or after mixing with other polymerizable monomers.

A polar resin may be added to the toner particle. As the polar resin, a polyester resin or a carboxyl-containing styrene resin is preferable. By using a polyester resin or a carboxyl-containing styrene resin as the polar resin, lubricity of the resin itself can be expected when the resin is unevenly distributed on the toner particle surface to form a shell.

A resin obtained by polycondensation of an alcohol monomer and a carboxylic acid monomer can be used as the polyester resin. Examples of the alcohol monomer are presented hereinbelow.

Bisphenol A alkylene oxide adducts such as polyoxypropylene (2,2)-2,2-bis(4-hydroxyphenyl)propane, polyoxypropylene (3,3)-2,2-bis(4-hydroxyphenyl)propane, polyoxyethylene (2,0)-2,2-bis(4-hydroxyphenyl)propane, polyoxypropylene (2,0)-polyoxyethylene (2,0)-2,2-bis(4-hydroxyphenyl)propane, polyoxypropylene (6)-2,2-bis(4-hydroxyphenyl)propane and the like; ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A, hydrogenated bisphenol A, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

Meanwhile, examples of the carboxylic acid monomer are presented hereinbelow.

Aromatic dicarboxylic acids such as phthalic acid, isophthalic acid and terephthalic acid or anhydrides thereof; alkyldicarboxylic acids such as succinic acid, adipic acid, sebacic acid and azelaic acid or anhydrides thereof; succinic acid substituted with an alkyl group or an alkenyl group having 6 to 18 carbon atoms, anhydrides thereof; unsaturated dicarboxylic acids such as fumaric acid, maleic acid and citraconic acid or anhydrides thereof.

In addition, the following monomers can be used.

Polyhydric alcohols such as glycerin, sorbit, sorbitan, and for example, oxyalkylene ethers of novolac type phenolic resins and the like; and polyvalent carboxylic acids such as trimellitic acid, pyromellitic acid, benzophenonetetracarboxylic acid and anhydrides thereof and the like.

Among them, a resin obtained by condensation polymerization of a polyester unit component having a bisphenol derivative represented by the following formula (1) as a dihydric alcohol monomer component and a divalent or higher carboxylic acid component as an acid monomer component is preferable because such a resin exhibits satisfactory charging characteristics. A carboxylic acid or an acid anhydride thereof, or a lower alkyl ester thereof can be used as the divalent or higher carboxylic acid component. Examples thereof include fumaric acid, maleic acid, maleic anhydride, phthalic acid, terephthalic acid, trimellitic acid, pyromellitic acid and the like.

(1)

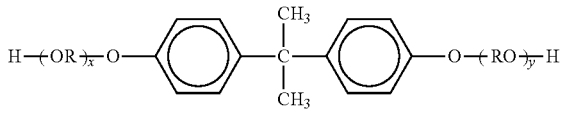

(In the formula, R represents an ethylene group or a propylene group, x and y each are an integer of 1 or more, and the average value of x+y is 2 to 10.)

As the carboxyl group-containing styrene resin, styrene acrylic acid copolymer, styrene methacrylic acid copolymer, styrene maleic acid copolymer and the like are preferable. In particular, a styrene-acrylic acid ester-acrylic acid copolymer is preferable because a charge quantity can be easily controlled. Further, it is more preferable that the carboxyl group-containing styrene resin include a monomer having a primary or secondary hydroxyl group. Specific examples of the polymer composition include styrene-2-hydroxyethyl methacrylate-methacrylic acid-methyl methacrylate copolymer, styrene-n-butyl acrylate-2-hydroxyethyl methacrylate-methacrylic acid-methyl methacrylate copolymer, styrene-α-methylstyrene-2-hydroxyethyl methacrylate-methacrylic acid-methyl methacrylate copolymer, and the like. A resin including a monomer having a primary or secondary hydroxyl group has a high polarity and a better long-term storability.

The amount of the polar resin is preferably from 1.0 parts by mass to 20.0 parts by mass, and more preferably from 2.0 parts by mass to 10.0 parts by mass with respect to 100.0 parts by mass of the binder resin or the polymerizable monomers that produce the binder resin.

The toner particle includes a colorant. Known colorants such as various dyes and pigments conventionally known can be used as the colorant.

As the black colorant, carbon black, magnetic bodies, or a colorant toned to black by using yellow/magenta/cyan colorants shown below can be used.

For example, monoazo compounds, disazo compounds, condensed azo compounds, isoindolinone compounds, anthraquinone compounds, azo metal complex methine compounds, and allyl amide compounds can be used as yellow colorants. Specific examples include C. I. Pigment Yellow 74, 93, 95, 109, 111, 128, 155, 174, 180, 185.

For example, monoazo compounds, condensed azo compounds, diketopyrrolopyrrole compounds, anthraquinone, quinacridone compounds, basic dye lake compounds, naphthol compounds, benzimidazolone compounds, thioindigo compounds, and perylene compounds can be used as the magenta colorant. Specific examples include C. I. Pigment Red 2, 3, 5, 6, 7, 23, 48:2, 48:3, 48:4, 57:1, 81:1, 122, 144, 146, 150, 166, 169, 177, 184, 185, 202, 206, 220, 221, 238, 254, 269, C. I. Pigment Violet 19 and the like.

For example, copper phthalocyanine compounds and derivatives thereof, anthraquinone compounds, and basic dye lake compounds can be used the cyan colorant. Specific examples include C. I. Pigment Blue 1, 7, 15, 15:1, 15:2, 15:3, 15:4, 60, 62, 66.

When the toner is used as a magnetic toner, a magnetic body may be included in the toner particle. In this case, the magnetic body may serve as a colorant. Examples of the magnetic body include iron oxides such as magnetite, hematite and ferrite; and metals such as iron, cobalt, and nickel. Other examples include alloys and mixture of these metals with metals such as aluminum, cobalt, copper, lead, magnesium, tin, zinc, antimony, beryllium, bismuth, cadmium, calcium, manganese, selenium, titanium, tungsten, and vanadium.

The colorant is selected from the viewpoints of hue angle, saturation, lightness, lightfastness, OHP transparency, and dispersibility in the toner particle. These colorants can be used singly or in a mixture, and also in a solid solution state. The colorant is preferably used in an amount of from 1.0 part by mass to 20.0 parts by mass with respect to 100.0 parts by mass of the binder resin or the polymerizable monomers that produce the binder resin.

The wax is not particularly limited and known waxes can be used.

In particular, in the present invention, it is preferable to include an ester wax from the viewpoint of adjusting low-temperature fixability and As. Examples of the ester waxes are presented hereinbelow.

Esters of monohydric alcohols and aliphatic carboxylic acids such as behenyl behenate, stearyl stearate and palmityl palmitate, or esters of monovalent carboxylic acids and aliphatic alcohols; esters of dihydric alcohols and aliphatic carboxylic acids such as ethylene glycol distearate, dibehenyl sebacate, hexane diol dibehenate, or esters of divalent carboxylic acids and aliphatic alcohols; esters of trihydric alcohols and aliphatic carboxylic acids such as glycerin tribehenate, or esters of trivalent carboxylic acids and aliphatic alcohols; esters of tetrahydric alcohols and aliphatic carboxylic acids such as pentaerythritol tetrastearate and pentaerythritol tetrapalmitate, or esters of tetravalent carboxylic acids and aliphatic alcohols; esters of hexahydric alcohols and aliphatic carboxylic acids such as dipentaerythritol hexastearate and dipentaerythritol hexapalmitate, or esters of hexavalent carboxylic acids and aliphatic alcohols; esters of polyhydric alcohols and aliphatic carboxylic acids such as polyglycerin behenate, or esters of polyvalent carboxylic acids and aliphatic alcohols; and natural ester waxes such as carnauba wax and rice wax.

Preferable among these are ester waxes having a number average molecular weight (Mn) of o-dichlorobenzene soluble matter of from 500 to 1000 as measured by high-temperature gel permeation chromatography (GPC). When the number average molecular weight (Mn) is 500 or more, the outmigration of wax to the toner particle surface is further reduced, and the development durability is further improved. In addition, when the number average molecular weight is 1000 or less, the plasticity with respect to the binder resin is high and the low-temperature fixability is further improved. The number average molecular weight is more preferably from 550 to 850.

From the viewpoint of balance between development durability and low-temperature fixability, it is preferable that the ester wax has a structure represented by the following formula (2) or formula (3).

(2)

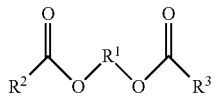

(3)

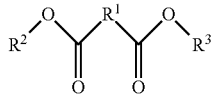

(In the formulas (2) and (3), $R^1$ represents an alkylene group having from 1 to 12 carbon atoms, and each of $R^2$ and $R^3$ independently represents a linear alkyl group having from 11 to 25 carbon atoms.)

The amount of the wax is preferably such that X is 3.0 or more and the (X/Y) ratio of X and Y is from 2.0 to 20.0, when X (% by mass) stands for the amount of wax and Y (% by mass) stands for the amount of the metal titanate fine particles, based on the total mass of the toner. Within this range, low-temperature fixability, paper separability, and the effect of paper ejection defects are well balanced. X is more preferably 5.0 or more. The upper limit of X is not particularly limited, but is preferably 25.0 or less, more preferably 20.0 or less. Further, X/Y is more preferably from 5.0 to 15.0.

Furthermore, Y is preferably from 0.2 to 10.0.

In addition to the ester wax, the following waxes may be included.

For example, aliphatic hydrocarbon waxes such as low-molecular weight polyethylene, low-molecular weight polypropylene, microcrystalline wax, paraffin wax, and Fischer Tropsch wax; oxides of aliphatic hydrocarbon waxes such as oxidized polyethylene wax or block copolymers thereof; waxes mainly composed of fatty acid esters such as carnauba wax, sazol wax, ester wax, and montanic acid ester wax; waxes obtained by partial or complete deoxidation of fatty acid esters such as deoxidized carnauba wax; waxes obtained by grafting a vinyl monomer such as styrene or acrylic acid onto an aliphatic hydrocarbon wax; partial esterification products of fatty acids and polyhydric alcohols such as behenic acid monoglyceride; and methyl ester compounds having hydroxyl groups obtained by hydrogenation or the like of vegetable oils and fats.

The melting point of the wax is preferably from 30° C. to 130° C., and more preferably from 60° C. to 100° C. By using the wax exhibiting the thermal properties as described above, not only satisfactory low-temperature fixability of the obtained toner but also release effect by wax is efficiently exhibited, and a sufficient fixing region is secured.

A charge control agent may be used for the toner particle. Among them, it is preferable to use a charge control agent that controls the toner particle to be negatively charged. Examples of the charge control agent are presented hereinbelow.

Organometallic compounds, chelate compounds, monoazo metal compounds, acetylacetone metal compounds, urea derivatives, metal-containing salicylic acid compounds, metal-containing naphthoic acid compounds, quaternary ammonium salts, calixarenes, silicon compounds, nonmetal carboxylic acid compounds and derivatives thereof. Further, a sulfonic acid resin having a sulfonic acid group, a sulfonic acid salt group, or a sulfonic acid ester group can be preferably used.

Specific examples of the charge control agent are presented hereinbelow. Metal compounds of aromatic carboxylic acids typified by salicylic acid, alkylsalicylic acids, dialkylsalicylic acids, naphthoic acid, dicarboxylic acids and the like; polymers or copolymers having a sulfonic acid group, a sulfonic acid salt group or a sulfonic acid ester group; metal salts or metal complexes of azo dyes or azo pigments; boron compounds, silicon compounds, calixarenes or the like.

Meanwhile, examples of the charge control agent for positive charging are presented hereinbelow. Quaternary ammonium salts and polymer compounds having a quaternary ammonium salt in a side chain, guanidine compounds, nigrosine compounds, imidazole compounds and the like.

Homopolymers of vinyl monomers including a sulfonic acid group typified by styrene sulfonic acid, 2-acrylamido-2-methylpropanesulfonic acid, 2-methacrylamido-2-methylpropanesulfonic acid, vinyl sulfonic acid, methacrylsulfonic acid and the like, or copolymers of vinyl monomers listed in the section on the binder resin and the aforementioned vinyl monomers including a sulfonic acid group can be used as the polymers or copolymers having a sulfonic acid group, a sulfonic acid salt group or a sulfonic acid ester group in a side chain.

The addition amount of the charge control agent is preferably from 0.01 parts by mass to 20.0 parts by mass, more preferably from 0.1 parts by mass to 10.0 parts by mass, and still more preferably from 0.5 parts by mass to 10.0 parts by mass with respect to 100.0 parts by mass of the binder resin or the polymerizable monomers that produce the binder resin.

Inorganic fine particles such as silica fine particles, titanium oxide and aluminum oxide can be suitably used as external additives other than the metal titanate fine particles. These inorganic fine particles are preferably hydrophobized with a hydrophobizing agent such as a silane coupling agent, silicone oil or a mixture thereof. The external additive is preferably used in an amount of from 0.1 parts by mass to 5.0 parts by mass, more preferably from 0.1 parts by mass to 3.0 parts by mass with respect to 100.0 parts by mass of the toner particle.

Further, known surfactants, organic dispersants, and inorganic dispersants can be used as the dispersion stabilizer to be added to the aqueous medium. Among them, the inorganic dispersants can be suitably used because such dispersants are unlikely to become unstable due to the polymerization temperature or elapsed time, can be easily washed and are unlikely to affect the toner adversely. Examples of the inorganic dispersants are presented hereinbelow.

Polyvalent metal salts of phosphoric acid such as tricalcium phosphate, magnesium phosphate, aluminum phosphate and zinc phosphate; carbonates such as calcium carbonate and magnesium carbonate; inorganic salts such as calcium metasilicate, calcium sulfate, and barium sulfate; inorganic oxides such as calcium hydroxide, magnesium hydroxide, aluminum hydroxide, silica, bentonite, and alumina.

These inorganic dispersants can be almost completely removed by dissolving them by adding an acid or an alkali after completion of polymerization.

Methods for calculating and measuring physical property values defined in the present invention are described below.

Calculation of As

The wax distribution state in the toner is evaluated by observing the cross section of the toner particle with a transmission electron microscope, calculating As from the cross-sectional area of the domains formed by the wax, and taking an average value of 100 arbitrarily selected toner particles.

Specifically, the toner is encapsulated in a visible-light-curable encapsulating resin (D-800, manufactured by Nisshin EM Co., Ltd.) and cut with an ultrasonic ultramicrotome (EMS, Leica Camera AG) to a thickness of 60 nm, and Ru staining is performed with a vacuum staining apparatus (manufactured by Filgen, Inc.). Thereafter, observation is performed with a transmission electron microscope (H7500, manufactured by Hitachi, Ltd.) at an acceleration voltage of 120 kV. An image of the toner cross section to be observed is captured by selecting 100 particles having a diameter within ±2.0 μm from the weight average particle diameter. Image processing software (Photoshop 5.0, made by Adobe) is used for the obtained image, and the distinction between the domains of the wax and the regions of the binder resin is clarified. More specifically, the domains of the wax can be distinguished in the following manner. In the image processing software, the threshold value of the brightness (gradation 255) is set to 160 to binarize the captured TEM image. At this time, the wax of the toner and the photocurable resin D-800 become the bright portions, and the parts other than the wax of the toner become the dark portions. The contour of the toner can be distinguished by the contrast between the toner and the photocurable resin.

Masking is carried out by leaving a surface layer region having a depth of 1.0 μm (including a boundary of 1.0 μm) from the toner particle surface (the contour of the cross section) in the cross section of the toner particle. Specifically, a line is drawn from the center of gravity of the toner particle cross section to a point on the contour of the toner particle cross section. On the line, a position at 1.0 μm in the direction from the outline to the center of gravity is specified. Then, this operation is carried out for one turn against the contour of the toner particle cross section to clearly show the surface layer region from the contour of the toner particle cross section to 1.0 μm. The percentage of the area occupied by the domains of the wax in the obtained area of the surface layer region is calculated and taken as As.

Method for Measuring Weight Average Particle Diameter (D4)

The weight average particle diameter (D4) of the toner is calculated as follows. A precision particle size distribution measuring apparatus "Coulter Counter Multisizer 3" (registered trademark, manufactured by Beckman Coulter, Inc.) based on a pore electric resistance method and equipped with an aperture tube having a diameter of 100 μm is used as a measurement apparatus. The dedicated software "Beckman Coulter Multisizer 3 Version 3.51" (manufactured by Beckman Coulter, Inc.), which is provided with the apparatus, is used to set the measurement conditions and analyze the measurement data. The measurement is performed with 25,000 effective measurement channels.

A solution prepared by dissolving special grade sodium chloride in ion exchanged water to a concentration of about 1% by mass, for example, "ISOTON II" (trade name) (manufactured by Beckman Coulter, Inc.), can be used as the electrolytic aqueous solution to be used for measurements.

The dedicated software is set up in the following manner before the measurement and analysis.

The total count number in a control mode is set to 50,000 particles on a "CHANGE STANDARD MEASUREMENT METHOD (SOM)" screen of the dedicated software, the number of measurements is set to 1, and a value obtained using "standard particles 10.0 μm" (manufactured by Beckman Coulter, Inc.) is set as a Kd value. The threshold and the noise level are automatically set by pressing a "MEASUREMENT BUTTON OF THRESHOLD/NOISE LEVEL". Further, the current is set to 1600 μA, the gain is set to 2, the electrolytic solution is set to ISOTON II (trade name), and "FLUSH OF APERTURE TUBE AFTER MEASUREMENT" is checked.

In the "PULSE TO PARTICLE DIAMETER CONVERSION SETTING" screen of the dedicated software, the bin interval is set to a logarithmic particle diameter, the particle diameter bin is set to a 256-particle diameter bin, and a particle diameter range is set from 2 μm to 60 μm.

A specific measurement method is described hereinbelow.

(1) Approximately 200 mL of the electrolytic aqueous solution is placed in a glass 250 mL round-bottom beaker dedicated to Multisizer 3, the beaker is set in a sample stand, and stirring with a stirrer rod is carried out counterclockwise at 24 rpm. Dirt and air bubbles in the aperture tube are removed by the "FLUSH OF APERTURE" function of the dedicated software.

(2) A total of 30 mL of the electrolytic aqueous solution is placed in a glass 100 mL flat-bottom beaker. Then, 0.3 mL of a diluted solution obtained by 3-fold mass dilution of "CONTAMINON N" (trade name) (10% by mass aqueous solution of a neutral detergent for washing precision measuring instruments of pH 7 consisting of a nonionic surfactant, an anionic surfactant, and an organic builder, manufactured by Wako Pure Chemical Industries, Ltd.) with ion exchanged water is added as a dispersing agent thereto.

(3) An ultrasonic disperser "Ultrasonic Dispersion System Tetora 150" (manufactured by Nikkaki Bios Co., Ltd.) with an electrical output of 120 W in which two oscillators with an oscillation frequency of 50 kHz are built in with a phase shift of 180 degrees is prepared. A total of 3.3 L of ion exchanged water is placed in the water tank of the ultrasonic disperser, and 2 mL of CONTAMINON N is added to the water tank.

(4) The beaker of (2) hereinabove is set in the beaker fixing hole of the ultrasonic disperser, and the ultrasonic disperser is actuated. Then, the height position of the beaker is adjusted so that the resonance state of the liquid surface of the electrolytic aqueous solution in the beaker is maximized.

(5) A total of 10 mg of the toner is added little by little to the electrolytic aqueous solution and dispersed therein in a state in which the electrolytic aqueous solution in the beaker of (4) hereinabove is irradiated with ultrasonic waves. Then, the ultrasonic dispersion process is further continued for 60 sec. In the ultrasonic dispersion, the water temperature in the water tank is appropriately adjusted to a temperature from 10° C. to 40° C.

(6) The electrolytic aqueous solution of (5) hereinabove in which the toner is dispersed is dropped using a pipette into the round bottom beaker of (1) hereinabove which has been set in the sample stand, and the measurement concentration is adjusted to be 5%. Then, measurement is conducted until the number of particles to be measured reaches 50,000.

(7) The measurement data are analyzed with the dedicated software provided with the apparatus, and the weight average particle diameter (D4) is calculated. The "AVERAGE DIAMETER" on the "ANALYSIS/VOLUME STATISTICAL VALUE (ARITHMETIC MEAN)" screen when the special software is set to graph/volume % is the weight average particle diameter (D4).

Number Average Particle Diameter of Primary Particles of Metal Titanate Fine Particles The number average particle diameter of the primary particles of the metal titanate fine particles is measured with a transmission electron microscope "JEM-2800" (JEOL Ltd.). The toner externally added with the metal titanate fine particles is observed, and the major diameter of the primary particles of 100 metal titanate fine particles is randomly measured in a field enlarged up to 200,000 times to determine the number average particle diameter. The observation magnification is appropriately adjusted according to the size of the metal titanate fine particles.

As a method of discriminating the metal titanate fine particles from other external additives of the toner, elemental analysis of the toner particle surface using the below-described X-ray photoelectron spectroscopy apparatus can be performed. Alternatively, it is also possible to discriminate the isolated metal titanate fine particles by similar elemental analysis.

In the method of isolating the metal titanate fine particles, the toner is ultrasonically dispersed in methanol to separate the metal titanate fine particles and other external additives and allowed to stand for 24 h. Toner particles can be isolated by separating and recovering the sedimented toner particle and the metal titanate fine particles and other external additives dispersed in the supernatant, and sufficiently drying. Also, by treating the supernatant by centrifugation, metal titanate fine particles can be isolated.

Whether or not the metal titanate fine particles have a perovskite crystal structure can be determined by analyzing the metal titanate fine particles isolated as described above with a powder X-ray diffractometer.

Diffraction Peaks of Strontium Titanate Fine Particles

A powder X-ray diffractometer "SmartLab" (manufactured by Rigaku Corporation, high-resolution X-ray diffractometer with horizontal sample mount) is used for measuring the positions of diffraction peaks of the strontium titanate fine particles. Analysis software "PDXL 2 (version 2.2.2.0)" provided with the diffractometer is used for calculation of Sb/Sa from the obtained peaks.

Sample Preparation

The measurement was carried out after uniformly loading a measurement sample in a Boro-Silicate capillary (manufactured by W. Muller) having a diameter of 0.5 mm.

Measurement Conditions

Tube: Cu
Optical system: CBO-E
Sample base: capillary sample base
Detector: D/tex Ultra 250 detector
Voltage: 45 kV
Current: 200 mA
Start angle: 10°
End angle: 60°
Sampling width: 0.02°
Speed measurement time setting value: 10
IS: 1 mm
RS1: 20 mm
RS2: 20 mm
Attenuator: Open
Capillary rotation speed setting value: 100

For other conditions, the initial setting values of the apparatus are used.

Analysis

First, the obtained peaks are subjected to peak separation processing using software "PDXL 2" provided with the apparatus. Peak separation is obtained by executing optimization by using "Split-Type Voigt Function" selectable with the PDXL, and the obtained integrated intensity value is used. The 2θ value of the diffraction peak top and the area thereof are thereby determined. Sb/Sa is calculated from the peak area of the predetermined 2θ value. Here, in the case of a large deviation between the calculation result of peak separation and the actually measured spectrum, processing such as manual setting of the baseline is performed, and adjustment is made so that the calculation result matches the actually measured spectrum.

Although the strontium titanate fine particles are hereinabove exemplified as the metal titanate fine particles, the same processing can be performed with respect to particles other than the strontium titanate fine particles.

Molar Ratio of Sr/Ti of Strontium Titanate Fine Particles

The amount of Sr and Ti in the strontium titanate fine particles can be measured with a fluorescent X-ray analyzer.

For example, a wavelength dispersive fluorescent X-ray analyzer Axios advanced (manufactured by PANalytical Co., Ltd.) is used, 1 g of a sample is weighed in a cup (dedicated to powder measurement recommended by PANalytical Co., Ltd.) to which a dedicated film has been attached, and elements from Na to U in the strontium titanate fine particles are measured by an FP method under a He atmosphere and atmospheric pressure.

In this case, it is assumed that all the detected elements are oxides, the total mass thereof is taken as 100%, the amount (% by mass) of SrO and $TiO_2$ relative to the total mass is determined by software SpectraEvaluation (version 5.0 L) as an oxide conversion value, and the molar ratio of Sr/Ti is then determined by converting oxygen into the amount of Sr and Ti.

Hydrophobicity of Strontium Titanate Fine Particles

The hydrophobicity of strontium titanate fine particles is measured by a powder wettability tester "WET-100P" (manufactured by RHESCA Co., Ltd.).

A spindle type rotor coated with a fluororesin and having a length of 25 mm and a maximum barrel diameter of 8 mm is placed in a cylindrical glass container having a diameter of 5 cm and a thickness of 1.75 mm. A total of 70 mL of water-containing methanol including of 50% by volume of methanol and 50% by volume of water is poured in the cylindrical glass container, then 0.5 g of the strontium titanate fine particles is added, and the container is set in the powder wettability tester.

Methanol is added to the liquid at a rate of 0.8 mL/min through the powder wettability tester while stirring at a rate of 200 rpm using a magnetic stirrer. The transmittance is measured with light having a wavelength of 780 nm, and the value represented by a volume percentage (=(volume of methanol/volume of mixture)×100) of methanol when the transmittance reaches 50% is taken as the hydrophobicity. The initial volume ratio of methanol and water is adjusted as appropriate according to the hydrophobicity of the sample.

Measurement of Amount X of Wax and Amount Y of Metal Titanate Fine Particles in Toner The amount X of the wax in the toner is measured using a thermal analyzer (DSC Q2000, manufactured by TA Instruments).

First, about 5.0 mg of the toner sample is placed in a sample container of an aluminum pan (KIT NO. 0219-0041), and the sample container is placed on a holder unit and set in an electric furnace.

A sample is heated in a nitrogen atmosphere from 30° C. to 200° C. at a heating rate of 10° C./min, and the DSC curve is measured by a differential scanning calorimeter (DSC) to calculate the endothermic amount of the wax in the toner sample. Also, using about 5.0 mg of the sample including only the wax, the endothermic amount is calculated by the same method. Then, using the obtained endothermic amounts of the wax, the amount of the wax is determined by the following formula (4).

$$\text{Amount } X \text{ (\% by mass) of wax in toner} = (\text{Endothermic amount } (J/g) \text{ of wax in toner sample})/(\text{Endothermic amount } (J/g) \text{ of wax alone}) \times 100 \quad (4)$$

With such a method for measuring the amount of the wax, even in the case where the wax flows out during the toner production process and a part of the charged wax is not contained in the toner, the wax amount in the toner particle can be effectively specified.

Next, the amount Y of the metal titanate fine particles in the toner is determined according to JIS K 0119-1969 by fluorescent X-ray measurement of each element. Specifically, the following procedure is used.

A wavelength dispersive fluorescent X-ray analyzer "Axios" (manufactured by PANalytical Co., Ltd.) is used as the measurement apparatus, and dedicated software "SuperQ ver. 4.0 F" (manufactured by PANalytical Co., Ltd.) is used for setting the measurement conditions and analyzing the measurement data. Rh is used as the anode of an X-ray tube, the measurement atmosphere is vacuum, the measurement diameter (collimator mask diameter) is 10 mm, and the measurement time is 10 sec.

A pellet as a measurement sample is prepared by placing approximately 4 g of the toner in a dedicated pressing aluminum ring, flattening, pressing at 20 MPa for 60 sec with a tablet compacting machine "BRE-32" (Maekawa Testing Machine MFG. Co., Ltd.), and molding to a thickness of about 2 mm and a diameter of about 39 mm.

The measurement is carried out under the above conditions, elements are identified on the basis of the obtained X-ray peak positions, and the amount Y thereof is calculated from the count rate (unit: cps) which is the number of X-ray photons per unit time.

EXAMPLES

Hereinafter, the present invention will be specifically described with reference to examples, but the present invention is not limited to these examples. The number of parts used in the examples is on a mass basis unless otherwise specified.

The strontium titanate fine particles were prepared in the following manner. Physical properties of the strontium titanate fine particles T1 to T8 are shown in Table 1.

Production Example 1 of Strontium Titanate Fine Particles

Metatitanic acid obtained by the sulfuric acid method was subjected to deironization bleaching treatment, then a sodium hydroxide aqueous solution was added to adjust the pH to 9.0, desulfurization treatment was carried out, and then neutralization to pH 5.8 was performed with hydrochloric acid, followed by filtration and washing. Water was added to the washed cake to make slurry with a concentration of 1.85 mol/L as $TiO_2$, hydrochloric acid was thereafter added to obtain the pH of 1.0, and peptization treatment was carried out.

A total of 1.88 mol, as $TiO_2$, of desulfurized and peptized metatitanic acid was collected and charged into a 3 L reaction vessel. A total of 2.16 mol of strontium chloride aqueous solution was added to the peptized metatitanic acid slurry so that the molar ratio of Sr/Ti became 1.15, and the $TiO_2$ concentration was adjusted to 1.039 mol/L. Next, after warming to 90° C. under stirring and mixing, 440 mL of a 10N sodium hydroxide aqueous solution was added over 45 min, and then the stirring was continued at 95° C. for 1 h to end the reaction.

The reaction slurry was cooled to 50° C., hydrochloric acid was added until the pH became 5.0, and stirring was continued for 20 min. The resulting precipitate was decanted and washed, filtered and separated, and then dried in air at 120° C. for 8 h.

Subsequently, 300 g of the dried product was loaded into a dry particle complexing apparatus (NOBILTA NOB-130 manufactured by Hosokawa Micron Corporation). The treatment was carried out at a treatment temperature of 30° C. for 10 min with a rotary treatment blade at 90 m/sec.

Further, hydrochloric acid was added to the dried product until the pH became 0.1, and stirring was continued for 1 h. The resulting precipitate was decanted and washed.

The slurry including the precipitate was adjusted to 40° C. and hydrochloric acid was added to adjust the pH to 2.5, then n-octyltriethoxysilane in an amount of 4.0% by weight based on the solid fraction was added, and stirring and holding were continued for 10 h. A 5N sodium hydroxide solution was added to adjust the pH to 6.5 and stirring was continued for 1 h, followed by filtration and washing, and the obtained cake was dried in air at 120° C. for 8 h to obtain strontium titanate fine particles T1 having perovskite crystal structure.

Production Example 2 of Strontium Titanate Fine Particles

Metatitanic acid obtained by the sulfuric acid method was subjected to deironization bleaching treatment, then a sodium hydroxide aqueous solution was added to adjust the pH to 9.0, desulfurization treatment was carried out, and then neutralization to pH 5.8 was performed with hydrochloric acid, followed by filtration and washing. Water was added to the washed cake to make slurry with a concentration of 1.85 mol/L as $TiO_2$, hydrochloric acid was thereafter added to obtain the pH of 1.0, and peptization treatment was carried out.

A total of 1.88 mol, as $TiO_2$, of desulfurized and peptized metatitanic acid was collected and charged into a 3 L reaction vessel. A total of 2.16 mol of strontium chloride aqueous solution was added to the peptized metatitanic acid slurry so that the molar ratio of Sr/Ti became 1.15, and the $TiO_2$ concentration was adjusted to 1.083 mol/L. Next, after warming to 90° C. under stirring and mixing, 440 mL of a 10N sodium hydroxide aqueous solution was added over 45 min, and then the stirring was continued at 95° C. for 1 h to end the reaction.

The reaction slurry was cooled to 50° C., hydrochloric acid was added until the pH became 5.0, and stirring was continued for 20 min. The resulting precipitate was decanted and washed, filtered and separated, and then dried in air at 120° C. for 8 h.

Subsequently, 300 g of the dried product was loaded into a dry particle complexing apparatus (NOBILTA NOB-130 manufactured by Hosokawa Micron Corporation). The treatment was carried out at a treatment temperature of 30° C. for 10 min with a rotary treatment blade at 90 m/sec.

Further, hydrochloric acid was added to the dried product until the pH became 0.1, and stirring was continued for 1 h. The resulting precipitate was decanted and washed.

The slurry including the precipitate was adjusted to 40° C. and hydrochloric acid was added to adjust the pH to 2.5, then n-octyltriethoxysilane in an amount of 4.0% by weight based on the solid fraction was added, and stirring and holding were continued for 10 h. A 5N sodium hydroxide solution was added to adjust the pH to 6.5 and stirring was continued for 1 h, followed by filtration and washing, and the obtained cake was dried in air at 120° C. for 8 h to obtain strontium titanate fine particles T2 having perovskite crystal structure.

Production Example 3 of Strontium Titanate Fine Particles

Metatitanic acid obtained by the sulfuric acid method was subjected to deironization bleaching treatment, then a sodium hydroxide aqueous solution was added to adjust the pH to 9.0, desulfurization treatment was carried out, and then neutralization to pH 5.8 was performed with hydrochloric acid, followed by filtration and washing. Water was added to the washed cake to make slurry with a concentration of 1.85 mol/L as $TiO_2$, hydrochloric acid was thereafter added to obtain the pH of 1.0, and peptization treatment was carried out.

A total of 1.88 mol, as $TiO_2$, of desulfurized and peptized metatitanic acid was collected and charged into a 3 L reaction vessel. A total of 2.16 mol of strontium chloride aqueous solution was added to the peptized metatitanic acid slurry so that the molar ratio of Sr/Ti became 1.15, and the $TiO_2$ concentration was adjusted to 0.941 mol/L. Next, after warming to 90° C. under stirring and mixing, 440 mL of a 10N sodium hydroxide aqueous solution was added over 45 min, and then the stirring was continued at 95° C. for 1 h to end the reaction.

The reaction slurry was cooled to 50° C., hydrochloric acid was added until the pH became 5.0, and stirring was continued for 20 min. The resulting precipitate was decanted and washed, filtered and separated, and then dried in air at 120° C. for 8 h.

Subsequently, 300 g of the dried product was loaded into a dry particle complexing apparatus (NOBILTA NOB-130 manufactured by Hosokawa Micron Corporation). The treatment was carried out at a treatment temperature of 30° C. for 10 min with a rotary treatment blade at 90 m/sec.

Further, hydrochloric acid was added to the dried product until the pH became 0.1, and stirring was continued for 1 h. The resulting precipitate was decanted and washed.

The slurry including the precipitate was adjusted to 40° C. and hydrochloric acid was added to adjust the pH to 2.5, then n-octyltriethoxysilane in an amount of 4.0% by weight based on the solid fraction was added, and stirring and holding were continued for 10 h. A 5N sodium hydroxide solution was added to adjust the pH to 6.5 and stirring was continued for 1 h, followed by filtration and washing, and the obtained cake was dried in air at 120° C. for 8 h to obtain strontium titanate fine particles T3 having perovskite crystal structure.

Production Example 4 of Strontium Titanate Fine Particles

Metatitanic acid obtained by the sulfuric acid method was subjected to deironization bleaching treatment, then a sodium hydroxide aqueous solution was added to adjust the pH to 9.0, desulfurization treatment was carried out, and then neutralization to pH 5.8 was performed with hydrochloric acid, followed by filtration and washing. Water was added to the washed cake to make slurry with a concentration of 1.85 mol/L as $TiO_2$, hydrochloric acid was thereafter added to obtain the pH of 1.0, and peptization treatment was carried out.

A total of 1.88 mol, as $TiO_2$, of desulfurized and peptized metatitanic acid was collected and charged into a 3 L reaction vessel. A total of 2.16 mol of strontium chloride aqueous solution was added to the peptized metatitanic acid slurry so that the molar ratio of Sr/Ti became 1.15, and the $TiO_2$ concentration was adjusted to 0.988 mol/L. Next, after warming to 90° C. under stirring and mixing, 440 mL of a 10N sodium hydroxide aqueous solution was added over 45 min, and then the stirring was continued at 95° C. for 1 h to end the reaction.

The reaction slurry was cooled to 50° C., hydrochloric acid was added until the pH became 5.0, and stirring was continued for 20 min. The resulting precipitate was decanted and washed, filtered and separated, and then dried in air at 120° C. for 8 h.

Subsequently, 300 g of the dried product was loaded into a dry particle complexing apparatus (NOBILTA NOB-130 manufactured by Hosokawa Micron Corporation). The treatment was carried out at a treatment temperature of 30° C. for 10 min with a rotary treatment blade at 90 m/sec.

Further, hydrochloric acid was added to the dried product until the pH became 0.1, and stirring was continued for 1 h. The resulting precipitate was decanted and washed.

The slurry including the precipitate was adjusted to 40° C. and hydrochloric acid was added to adjust the pH to 2.5, then n-octyltriethoxysilane in an amount of 4.0% by weight based on the solid fraction was added, and stirring and holding were continued for 10 h. A 5N sodium hydroxide solution was added to adjust the pH to 6.5 and stirring was continued for 1 h, followed by filtration and washing, and the obtained cake was dried in air at 120° C. for 8 h to obtain strontium titanate fine particles T4 having perovskite crystal structure.

Production Example 5 of Strontium Titanate Fine Particles

Metatitanic acid obtained by the sulfuric acid method was subjected to deironization bleaching treatment, then a sodium hydroxide aqueous solution was added to adjust the pH to 9.0, desulfurization treatment was carried out, and then neutralization to pH 5.8 was performed with hydrochloric acid, followed by filtration and washing. Water was added to the washed cake to make slurry with a concentration of 1.85 mol/L as $TiO_2$, hydrochloric acid was thereafter added to obtain the pH of 1.0, and peptization treatment was carried out.

A total of 1.88 mol, as $TiO_2$, of desulfurized and peptized metatitanic acid was collected and charged into a 3 L reaction vessel. A total of 2.16 mol of strontium chloride aqueous solution was added to the peptized metatitanic acid slurry so that the molar ratio of Sr/Ti became 1.15, and the $TiO_2$ concentration was adjusted to 1.039 mol/L. Next, after warming to 90° C. under stirring and mixing, 440 mL of a 10N sodium hydroxide aqueous solution was added over 45 min, and then the stirring was continued at 95° C. for 1 h to end the reaction.

The reaction slurry was cooled to 50° C., hydrochloric acid was added until the pH became 5.0, and stirring was continued for 20 min. The resulting precipitate was decanted and washed, filtered and separated, and then dried in air at 120° C. for 8 h.

Subsequently, 300 g of the dried product was loaded into a dry particle complexing apparatus (NOBILTA NOB-130 manufactured by Hosokawa Micron Corporation). The treatment was carried out at a treatment temperature of 30° C. for 15 min with a rotary treatment blade at 90 m/sec.

Further, hydrochloric acid was added to the dried product until the pH became 0.1, and stirring was continued for 1 h. The resulting precipitate was decanted and washed.

The slurry including the precipitate was adjusted to 40° C. and hydrochloric acid was added to adjust the pH to 2.5, then n-octyltriethoxysilane in an amount of 4.0% by weight based on the solid fraction was added, and stirring and holding were continued for 10 h. A 5N sodium hydroxide solution was added to adjust the pH to 6.5 and stirring was continued for 1 h, followed by filtration and washing, and the obtained cake was dried in air at 120° C. for 8 h to obtain strontium titanate fine particles T5 having perovskite crystal structure.

Production Example 6 of Strontium Titanate Fine Particles

Metatitanic acid obtained by the sulfuric acid method was subjected to deironization bleaching treatment, then a sodium hydroxide aqueous solution was added to adjust the pH to 9.0, desulfurization treatment was carried out, and then neutralization to pH 5.8 was performed with hydrochloric acid, followed by filtration and washing. Water was added to the washed cake to make slurry with a concentration of 1.85 mol/L as $TiO_2$, hydrochloric acid was thereafter added to obtain the pH of 1.0, and peptization treatment was carried out.

A total of 1.88 mol, as $TiO_2$, of desulfurized and peptized metatitanic acid was collected and charged into a 3 L reaction vessel. A total of 2.54 mol of strontium chloride aqueous solution was added to the peptized metatitanic acid slurry so that the molar ratio of Sr/Ti became 1.35, and the $TiO_2$ concentration was adjusted to 1.039 mol/L. Next, after warming to 90° C. under stirring and mixing, 440 mL of a 10N sodium hydroxide aqueous solution was added over 45 min, and then the stirring was continued at 95° C. for 1 h to end the reaction.

The reaction slurry was cooled to 50° C., hydrochloric acid was added until the pH became 5.0, and stirring was continued for 20 min. The resulting precipitate was decanted and washed, filtered and separated, and then dried in air at 120° C. for 8 h.

Subsequently, 300 g of the dried product was loaded into a dry particle complexing apparatus (NOBILTA NOB-130 manufactured by Hosokawa Micron Corporation). The treatment was carried out at a treatment temperature of 30° C. for 10 min with a rotary treatment blade at 90 m/sec.

Further, hydrochloric acid was added to the dried product until the pH became 0.1, and stirring was continued for 1 h. The resulting precipitate was decanted and washed.

The slurry including the precipitate was adjusted to 40° C. and hydrochloric acid was added to adjust the pH to 2.5, then n-octyltriethoxysilane in an amount of 4.0% by weight based on the solid fraction was added, and stirring and holding were continued for 10 h. A 5N sodium hydroxide solution was added to adjust the pH to 6.5 and stirring was continued for 1 h, followed by filtration and washing, and the obtained cake was dried in air at 120° C. for 8 h to obtain strontium titanate fine particles T6 having perovskite crystal structure.

Production Example 7 of Strontium Titanate Fine Particles

Metatitanic acid obtained by the sulfuric acid method was subjected to deironization bleaching treatment, then a sodium hydroxide aqueous solution was added to adjust the pH to 9.0, desulfurization treatment was carried out, and then neutralization to pH 5.8 was performed with hydrochloric acid, followed by filtration and washing. Water was added to the washed cake to make slurry with a concentration of 1.85 mol/L as $TiO_2$, hydrochloric acid was thereafter added to obtain the pH of 1.0, and peptization treatment was carried out.

A total of 1.88 mol, as $TiO_2$, of desulfurized and peptized metatitanic acid was collected and charged into a 3 L reaction vessel. A total of 2.16 mol of strontium chloride aqueous solution was added to the peptized metatitanic acid slurry so that the molar ratio of Sr/Ti became 1.15, and the $TiO_2$ concentration was adjusted to 1.039 mol/L. Next, after warming to 90° C. under stirring and mixing, 440 mL of a 10N sodium hydroxide aqueous solution was added over 45 min, and then the stirring was continued at 95° C. for 1 h to end the reaction.

The reaction slurry was cooled to 50° C., hydrochloric acid was added until the pH became 5.0, and stirring was continued for 1 h. The resulting precipitate was decanted and washed.

The slurry including the precipitate was adjusted to 40° C. and hydrochloric acid was added to adjust the pH to 2.5, then n-octyltriethoxysilane in an amount of 4.0% by weight based on the solid fraction was added, and stirring and holding were continued for 10 h. A 5N sodium hydroxide solution was added to adjust the pH to 6.5 and stirring was continued for 1 h, followed by filtration and washing, and the obtained cake was dried in air at 120° C. for 8 h to obtain strontium titanate fine particles T7 having perovskite crystal structure.

Production Example 8 of Strontium Titanate Fine Particles

Metatitanic acid obtained by the sulfuric acid method was subjected to deironization bleaching treatment, then a sodium hydroxide aqueous solution was added to adjust the pH to 9.0, desulfurization treatment was carried out, and then neutralization to pH 5.8 was performed with hydrochloric acid, followed by filtration and washing. Water was added to the washed cake to make slurry with a concentration of 1.85 mol/L as $TiO_2$, hydrochloric acid was thereafter added to obtain the pH of 1.0, and peptization treatment was carried out.

A total of 1.88 mol, as $TiO_2$, of desulfurized and peptized metatitanic acid was collected and charged into a 3 L reaction vessel. A total of 2.16 mol of strontium chloride aqueous solution was added to the peptized metatitanic acid slurry so that the molar ratio of Sr/Ti became 1.15, and the $TiO_2$ concentration was adjusted to 0.897 mol/L. Next, after warming to 90° C. under stirring and mixing, 440 mL of a 10N sodium hydroxide aqueous solution was added over 45 min, and then the stirring was continued at 95° C. for 1 h to end the reaction.

The reaction slurry was cooled to 50° C., hydrochloric acid was added until the pH became 5.0, and stirring was continued for 20 min. The resulting precipitate was decanted and washed, filtered and separated, and then dried in air at 120° C. for 8 h.

Subsequently, 300 g of the dried product was loaded into a dry particle complexing apparatus (NOBILTA NOB-130 manufactured by Hosokawa Micron Corporation). The treatment was carried out at a treatment temperature of 30° C. for 10 min with a rotary treatment blade at 90 m/sec.

Further, hydrochloric acid was added to the dried product until the pH became 0.1, and stirring was continued for 1 h. The resulting precipitate was decanted and washed.

The slurry including the precipitate was adjusted to 40° C. and hydrochloric acid was added to adjust the pH to 2.5, then n-octyltriethoxysilane in an amount of 4.0% by weight based on the solid fraction was added, and stirring and holding were continued for 10 h. A 5N sodium hydroxide solution was added to adjust the pH to 6.5 and stirring was continued for 1 h, followed by filtration and washing, and the obtained cake was dried in air at 120° C. for 8 h to obtain strontium titanate fine particles T8 having perovskite crystal structure.

TABLE 1

| Strontium titanate fine particle No. | Number average particle diameter of primary particles (nm) | X-ray diffraction: Presence or absence of peak at 39.700° ± 0.150° | X-ray diffraction: Presence or absence of peak at 46.200° ± 0.150° | Sb/Sa | Sr/Ti molar ratio | Hydrophobicity (%) |
|---|---|---|---|---|---|---|
| T1 | 35 | Present | Present | 2.03 | 0.79 | 75 |
| T2 | 15 | Present | Present | 1.98 | 0.75 | 73 |
| T3 | 78 | Present | Present | 2.21 | 0.79 | 74 |
| T4 | 58 | Present | Present | 2.06 | 0.81 | 77 |
| T5 | 32 | Present | Present | 1.82 | 0.73 | 75 |
| T6 | 42 | Present | Present | 2.22 | 0.86 | 76 |
| T7 | 38 | Present | Present | 2.33 | 0.78 | 75 |
| T8 | 101 | Present | Present | 2.18 | 0.78 | 75 |

Titanium oxide particles for comparative examples were prepared as follows.

Production Example 1 of Titanium Oxide Fine Particles

In a stainless steel container, 100 parts of rutile type titanium oxide having a weight average particle diameter of 35 nm was dispersed in ion exchanged water to prepare a slurry (including 6% by mass of titanium oxide) adjusted to pH 7. Thereafter, n-octyltriethoxysilane in an amount of 4.0% by weight based on the solid fraction was added to the slurry, and stirring was continued for 10 h. A 5N sodium hydroxide solution was added to adjust the pH to 6.5 and stirring was continued for 1 h, followed by filtration and washing. The obtained cake was dried in air at 120° C. for 8 h to obtain titanium oxide fine particles T9 having a rutile crystal structure. The hydrophobicity of T9 was 76%.

Production Example 2 of Titanium Oxide Fine Particles

In a stainless steel container, 100 parts of anatase type titanium oxide having a weight average particle diameter of 35 nm was dispersed in ion exchanged water to prepare a slurry (including 6% by mass of titanium oxide) adjusted to pH 7. Thereafter, n-octyltriethoxysilane in an amount of 4.0% by weight based on the solid fraction was added to the slurry, and stirring was continued for 10 h. A 5N sodium hydroxide solution was added to adjust the pH to 6.5 and stirring was continued for 1 h, followed by filtration and washing. The obtained cake was dried in air at 120° C. for 8 h to obtain titanium oxide fine particles T9 having an anatase crystal structure. The hydrophobicity of T10 was 78%.

PRODUCTION EXAMPLE OF TONER PARTICLE

The names and physical properties of ester waxes A1 to A4 used in Examples and Comparative Examples are shown in Table 2.

TABLE 2

| | Composition | Melting point | Notes |
|---|---|---|---|
| Wax A1 | Distearyl sebacate | 66° C. | |
| Wax A2 | Fischer Tropsch wax | 75° C. | HNP-9, Nippon Seiro Co., Ltd. |
| Wax A3 | Ethylene glycol distearate | 76° C. | |
| Wax A4 | Dipentaerythritol hexastearate | 77° C. | |

Production Example of Toner Particle 1

A mixture including the following polymerizable monomers was prepared.

| | |
|---|---|
| Styrene | 75.0 parts |
| n-Butyl acrylate | 25.0 parts |
| Copper phthalocyanine pigment (Pigment Blue 15:3) | 6.5 parts |
| Polar resin (styrene-2-hydroxyethyl methacrylate-methacrylic acid-methyl methacrylate copolymer (mass ratio 95:2:2:3), acid value 10 mg KOH/g, glass transition point (Tg) = 80° C., weight average molecular weight (Mw) = 15,000) | 5.0 parts |
| Wax A1: | 15.0 parts |

Ceramic beads having a diameter of 15 mm were placed in the mixture, and the mixture was dispersed for 2 h using a wet attritor (manufactured by Nippon Coke & Engineering Co., Ltd.) to obtain a polymerizable monomer composition.

Meanwhile, 6.3 parts of sodium phosphate ($Na_3PO_4$) was added to 414.0 parts of ion exchanged water, and the mixture was heated to 60° C. under stirring by using CLEARMIX (manufactured by M Technique Co., Ltd.). Thereafter, a calcium chloride aqueous solution prepared by dissolving 3.6 parts of calcium chloride ($CaCl_2$) in 25.5 parts of ion exchanged water was added and further stirring was continued to prepare an aqueous medium including a dispersion stabilizer composed of tricalcium phosphate ($Ca_3(PO_4)_2$).

A total of 9.0 parts of PERBUTYL PV (a 10-h half-life temperature of 54.6° C. (manufactured by NOF Corporation)), which is a polymerization initiator, was added to the polymerizable monomer composition, and the resulting composition was loaded into the aqueous dispersion medium. A 10-min granulation step was carried out while maintaining 12,000 rpm with the CLEARMIX. Next, in a stirring tank equipped with a general stirrer, polymerization was carried out for 5 h while maintaining 85° C. under stirring.

Next, as a cooling step, ice was loaded and cooling was performed from 85° C. to 35° C. at 5° C./s.

Next, the temperature of the wax crystallization step was raised to 60° C. at 2° C./min and held for 3 h to obtain a toner particle-dispersed solution.

After cooling the toner particle-dispersed solution, hydrochloric acid was added, the pH was adjusted to 1.4 or less, the solution was allowed to stand for 1 h under stirring, and solid-liquid separation was performed with a pressure filter to obtain a toner cake. The toner cake was re-slurried with ion exchanged water to prepare a dispersion liquid again, followed by solid-liquid separation with the aforementioned filter. The re-slurrying and solid-liquid separation were repeated until the electric conductivity of the filtrate became 5.0 μS/cm or less, and finally the solid-liquid separation was performed to obtain a toner cake.

The resulting toner cake was dried with an air flow dryer FLASH JET DRYER (manufactured by Seishin Enterprise Co., Ltd.). The drying conditions were adjusted to a blowing temperature of 90° C. and a dryer outlet temperature of 40° C., and the toner cake feeding speed was adjusted according to the moisture content of the toner cake to a speed at which the outlet temperature did not deviate from 40° C.

Further, the fine and coarse powders were cut using a multi-division classifier utilizing the Coanda effect to obtain a toner particle 1.

Production Example of Toner Particle 2

A toner particle 2 was obtained by exactly the same method, except that 15.0 parts of wax A1 were changed to 15.0 parts of wax A2 in production of the toner particle 1.

Production Example of Toner Particle 3

A mixture including the following polymerizable monomers was prepared.

| | |
|---|---|
| Styrene | 75.0 parts |
| n-Butyl acrylate | 25.0 parts |
| Copper phthalocyanine pigment (Pigment Blue 15:3) | 6.5 parts |
| Polar resin (styrene-2-hydroxyethyl methacrylate-methacrylic acid-methyl methacrylate copolymer (mass ratio 95:2:2:3), acid value 10 mg KOH/g, glass transition point (Tg) = 80° C., weight average molecular weight (Mw) = 15,000) | 5.0 parts |
| Wax A1: | 15.0 parts |

Ceramic beads having a diameter of 15 mm were placed in the mixture, and the mixture was dispersed for 2 h using a wet attritor (manufactured by Nippon Coke & Engineering Co., Ltd.) to obtain a polymerizable monomer composition.

Meanwhile, 6.3 parts of sodium phosphate ($Na_3PO_4$) was added to 414.0 parts of ion exchanged water, and the mixture was heated to 60° C. under stirring by using CLEARMIX (manufactured by M Technique Co., Ltd.). Thereafter, a calcium chloride aqueous solution prepared by dissolving 3.6 parts of calcium chloride ($CaCl_2$) in 25.5 parts of ion exchanged water was added and further stirring was continued to prepare an aqueous medium including a dispersion stabilizer composed of tricalcium phosphate ($Ca_3(PO_4)_2$).

A total of 9.0 parts of PERBUTYL PV (a 10-h half-life temperature of 54.6° C. (manufactured by NOF Corporation)), which is a polymerization initiator, was added to the polymerizable monomer composition, and the resulting composition was loaded into the aqueous dispersion medium. A 10-min granulation step was carried out while maintaining 12,000 rpm with the CLEARMIX. Next, in a stirring tank equipped with a general stirrer, polymerization was carried out for 5 h while maintaining 85° C. under stirring to obtain a toner particle-dispersed solution.

Next, as a cooling step, ice was loaded and cooling was performed from 85° C. to 35° C. at 5° C./s.

After cooling the toner particle-dispersed solution, hydrochloric acid was added, the pH was adjusted to 1.4 or less, the solution was allowed to stand for 1 h under stirring, and solid-liquid separation was performed with a pressure filter to obtain a toner cake. The toner cake was re-slurried with ion exchanged water to prepare a dispersion liquid again, followed by solid-liquid separation with the aforementioned filter. The re-slurrying and solid-liquid separation were repeated until the electric conductivity of the filtrate became 5.0 μS/cm or less, and finally the solid-liquid separation was performed to obtain a toner cake.

The resulting toner cake was dried with an air flow dryer FLASH JET DRYER (manufactured by Seishin Enterprise Co., Ltd.). The drying conditions were adjusted to a blowing temperature of 90° C. and a dryer outlet temperature of 40° C., and the toner cake feeding speed was adjusted according to the moisture content of the toner cake to a speed at which the outlet temperature did not deviate from 40° C.

Further, the fine and coarse powders were cut using a multi-division classifier utilizing the Coanda effect.

Next, a wax distribution control step (exposure treatment with carbon dioxide) was performed.

A total of 20 parts of pre-treated toner particles were placed into a tank Ta of the apparatus shown in FIG. 1, the internal temperature was adjusted to 25° C., a valve V1 was opened under stirring at 150 rpm, and a pump P was used to introduce carbon dioxide (99.99% purity) from a cylinder B into the tank Ta. Valves V1 and V2 were adjusted to increase the pressure inside the tank Ta to 2.5 MPa. Thereafter, the pump P was stopped, the valve V1 was closed, the valve V2 was adjusted so that the inside of the tank was hermetically sealed, and the pressure was held for 60 min. Thereafter, the valve V2 was adjusted to discharge the carbon dioxide to the outside of the tank Ta, and the pressure of the tank Ta was reduced to the atmospheric pressure. After that, the stirring was stopped, and the tank Ta was opened to obtain a post-treated toner particle 3.

Production Example of Toner Particle 4

The preparation of the aqueous medium including the dispersion stabilizer in the production of the toner particles 1 was changed as follows. A total of 8.2 parts of sodium phosphate ($Na_3PO_4$) was loaded into 414.0 parts of ion exchanged water, and the mixture was heated to 60° C. while stirring by using CLEARMIX (manufactured by M Technique Co., Ltd.). Thereafter, an aqueous solution of calcium chloride prepared by dissolving 4.7 parts of calcium chloride ($CaCl_2$) in 25.5 parts of ion exchanged water was added and further stirring was continued to prepare an aqueous medium including a dispersion stabilizer composed of tricalcium phosphate ($Ca_3(PO_4)_2$). Other than that, a toner particle 4 was obtained by exactly the same method.

Production Example of Toner Particle 5

The preparation of the aqueous medium including the dispersion stabilizer and the granulation step in the production of the toner particles 1 were changed as follows. A total of 8.2 parts of sodium phosphate ($Na_3PO_4$) was loaded into 414.0 parts of ion exchanged water, and the mixture was heated to 60° C. while stirring by using CLEARMIX (manufactured by M Technique Co., Ltd.). Thereafter, an aqueous solution of calcium chloride prepared by dissolving 4.7 parts of calcium chloride ($CaCl_2$) in 25.5 parts of ion exchanged water was added and further stirring was continued to prepare an aqueous medium including a dispersion stabilizer composed of tricalcium phosphate ($Ca_3(PO_4)_2$).

Next, 9.0 parts of PERBUTYL PV (a 10-h half-life temperature of 54.6° C. (manufactured by NOF Corporation)), which is a polymerization initiator, was added to the polymerizable monomer composition, and the resulting composition was loaded into the aqueous dispersion medium. A 13-min granulation step was carried out while maintaining 12,000 rpm with CLEARMIX. Other than that, a toner particle 5 was obtained by exactly the same method.

Production Example of Toner Particle 6

The preparation of the aqueous medium including the dispersion stabilizer in the production of the toner particles 1 was changed as follows. A total of 5.0 parts of sodium phosphate ($Na_3PO_4$) was loaded into 414.0 parts of ion exchanged water, and the mixture was heated to 60° C. while stirring by using CLEARMIX (manufactured by M Technique Co., Ltd.). Thereafter, an aqueous solution of calcium chloride prepared by dissolving 2.9 parts of calcium chloride ($CaCl_2$) in 25.5 parts of ion exchanged water was added and further stirring was continued to prepare an aqueous medium including a dispersion stabilizer composed of tricalcium phosphate ($Ca_3(PO_4)_2$). Other than that, a toner particle 6 was obtained by exactly the same method.

Production Example of Toner Particle 7

The preparation of the aqueous medium including the dispersion stabilizer and the granulation step in the production of the toner particles 1 were changed as follows. A total of 5.0 parts of sodium phosphate ($Na_3PO_4$) was loaded into 414.0 parts of ion exchanged water, and the mixture was heated to 60° C. while stirring by using CLEARMIX (manufactured by M Technique Co., Ltd.). Thereafter, an aqueous solution of calcium chloride prepared by dissolving 2.9 parts of calcium chloride ($CaCl_2$) in 25.5 parts of ion exchanged water was added and further stirring was continued to prepare an aqueous medium including a dispersion stabilizer composed of tricalcium phosphate ($Ca_3(PO_4)_2$). Next, 9.0 parts of PERBUTYL PV (a 10-h half-life temperature of 54.6° C. (manufactured by NOF Corporation)), which is a polymerization initiator, was added to the polymerizable monomer composition, and the resulting composition was loaded into the aqueous dispersion medium. An 8-min granulation step was carried out while maintaining 12,000 rpm with CLEARMIX. Other than that, a toner particle 7 was obtained by exactly the same method.

Production Example of Toner Particle 8

A toner particle 8 was obtained by exactly the same method, except that 15.0 parts of wax A1 in the production of the toner particle 1 was changed to 3.0 parts of wax A1.

Production Example of Toner Particle 9

A toner particle 9 was obtained by exactly the same method, except that 15.0 parts of wax A1 in the production of the toner particle 1 was changed to 3.5 parts of wax A1.

Production Example of Toner Particle 10

A toner particle 10 was obtained by exactly the same method, except that 15.0 parts of wax A1 in the production of the toner particle 1 were changed to 15.0 parts of wax A3.

Production Example of Toner Particle 11

Preparation of Resin Particle-dispersed Solution

Preparation of Amorphous Resin Particle-dispersed Solution (A1)

| | |
|---|---|
| Terephthalic acid: | 25 mol parts |
| Fumaric acid: | 75 mol parts |
| Bisphenol A ethylene oxide (2.2 mol) adduct: | 5 mol parts |
| Bisphenol A propylene oxide (2.2 mol) adduct: | 95 mol parts |

The above materials were placed in a flask having an internal capacity of 5 L and equipped with a stirrer, a nitrogen introduction tube, a temperature sensor, and a rectification tower, the temperature was raised to 210° C. over 1 h, and 1 part of titanium tetraethoxide was loaded per 100 parts of the above materials. The temperature was raised to 230° C. over 0.5 h while distilling off the produced water, the dehydration condensation reaction was continued for 1 h at that temperature, and the reaction product was thereafter cooled. An amorphous polyester resin (A1) having a weight average molecular weight of 18,500, an acid value of 14 mg KOH/g, and a glass transition temperature of 59° C. was thus synthesized.

A total of 40 parts of ethyl acetate and 25 parts of 2-butanol were loaded into a vessel equipped with a temperature regulating means and a nitrogen replacing means to prepare a mixed solvent, and then 100 parts of the amorphous polyester resin (1) was gradually loaded and dissolved. Here, a 10%-by-mass ammonia aqueous solution (amount equivalent to 3 times the molar ratio with respect to the acid value of the resin) was added and stirred for 30 min.

Subsequently, the interior of the vessel was replaced with dry nitrogen, 400 parts of ion exchanged water was added dropwise at a rate of 2 parts/min while maintaining the temperature at 40° C. and stirring the mixture, and emulsification was carried out. After completion of the dropwise addition, the emulsion was returned to room temperature (20° C. to 25° C.) and bubbling was carried out with dry nitrogen for 48 h under stirring to reduce ethyl acetate and 2-butanol to 1000 ppm or less and obtain an amorphous resin particle-dispersed solution in which amorphous resin particles having a diameter of 200 nm were dispersed. Ion exchanged water was added to the resin particle-dispersed solution, and the amount of solid fraction was adjusted to 20% by mass to obtain an amorphous resin particle-dispersed solution (A1).

Preparation of Colorant Particle-dispersed Solution

Preparation of Colorant Particle-dispersed Solution (1)

| | |
|---|---|
| Cyan pigment: C.I. Pigment Blue 15:3 (copper phthalocyanine, manufactured by DIC Corp., trade name: FASTOGEN BLUE LA 5380): | 70 parts |
| Anionic surfactant (NEOGEN RK, manufactured by Dai-ichi Kogyo Seiyaku Co., Ltd.): | 5 parts |
| Ion exchanged water: | 200 parts |

The above materials were mixed and dispersed for 10 min by using a homogenizer (ULTRA TURRAX T50, manufactured by IKA Works, Inc.). Ion exchanged water was added so that the amount of solid fraction in the dispersion became 20% by mass to obtain a colorant particle-dispersed solution (1) in which colorant particles having a volume average particle diameter of 190 nm were dispersed.

Preparation of Release Agent Particle-dispersed Solution

Preparation of Release Agent Particle-dispersed Solution (1)

| | |
|---|---|
| Wax A1 | 100 parts |
| Anionic surfactant (NEOGEN RK, manufactured by Dai-ichi Kogyo Seiyaku Co., Ltd.) | 1 part |
| Ion exchanged water | 350 parts |

The above materials were mixed, heated to 100° C., dispersed using a homogenizer (ULTRA TURRAX T50, manufactured by IKA Works, Inc.), and then dispersed with a Manton-Gaulin high-pressure homogenizer (manufactured by Gaulin Co.) to obtain a release agent particle-dispersed solution (1) (amount of solid fraction: 20% by mass) in which release agent particles having a volume average particle diameter of 200 nm were dispersed.

Preparation of Toner Particle

An apparatus was prepared in which a round stainless steel flask and a container A were connected by a tube pump A, the liquid stored in the container A was fed to the flask by driving the tube pump A, the container A and a container B were connected by a tube pump B, and the liquid stored in the container B was fed to the container A by driving the tube pump B. Then, the following operations were carried out using this apparatus.

| | |
|---|---|
| Amorphous resin particle-dispersed solution (A1): | 500 parts |
| Colorant particle-dispersed solution (1): | 40 parts |
| Anionic surfactant (Tayca Power): | 2 parts |

The above materials were placed in a round stainless steel flask, pH was adjusted to 3.5 by adding 0.1 N nitric acid, and then 30 parts of a nitric acid aqueous solution with a polyaluminum chloride concentration of 10% by mass was added. Subsequently, after dispersing at 30° C. by using a homogenizer (ULTRA TURRAX T50, manufactured by IKA Works, Inc.), the aggregated particles were grown while increasing the temperature in a heating oil bath at a rate of 1° C./30 min.

Meanwhile, 150 parts of the amorphous resin particle-dispersed solution (A1) was placed in the container A of the polyester bottle, and 20 parts of the release agent particle-dispersed solution (1) was also placed in the container B. Next, the liquid pumping speed of the tube pump A was set to 0.68 parts per 1 min, the liquid pumping speed of the tube pump B was set to 0.13 parts per 1 min, the tube pumps A and B were driven from the point of time at which the temperature in the round stainless steel flask during the aggregate particle formation reached 36° C. and pumping of each dispersion was started. As a result, the mixed dispersion liquid in which the amorphous resin particles and the release agent particles were dispersed was pumped from the container A to the round stainless steel flask during the aggregate particle formation, while gradually increasing the concentration of the release agent particles.

Then, after each dispersion liquid was pumped to the flask and the temperature in the flask reached 48° C., the temperature was maintained for 30 min to form second aggregated particles. Thereafter, 50 parts of the amorphous resin particle-dispersed solution (A1) was slowly added, the system was held for 1 h, and after adjusting the pH to 8.5 by adding 0.1 N sodium hydroxide aqueous solution, heating to 85° C. was performed under stirring, followed by holding at this temperature for 5 h. Thereafter, the mixture was cooled to 20° C. at a rate of 20° C./min, filtered, thoroughly washed with ion exchanged water, and dried to obtain a toner particle 11 having a volume average particle diameter of 6.0 μm.

Production Example of Toner Particle 12

A toner particle 12 was obtained by exactly the same method as in the production of the toner particle 11 except that 100 parts of wax A1 in the release agent particle-dispersed solution was changed to 100 parts of wax A2.

Production Example of Toner Particle 13

A toner particle 13 was obtained by exactly the same method as in the production of the toner particle 1 except that 15.0 parts of wax A1 was changed to 15.0 parts of wax A2 and the cooling step and the wax crystallization step were omitted.

Production Example of Toner Particle 14

A toner particle 14 was obtained by exactly the same method as in the production of the toner particle 1 except that 15.0 parts of wax A1 was changed to 15.0 parts of wax A4.

Production Example of Toner Particle 15

A toner particle 15 was obtained by exactly the same method as in the production of the toner particle 3 except that 15.0 parts of wax A1 was changed to 15.0 parts of wax A3.

PRODUCTION EXAMPLE OF TONER

Production Example of Toner 1

Strontium titanate fine particles T1 (0.7 parts) and fumed silica fine particles (BET: 200 $m^2/g$) (1.0 part) were externally mixed with the obtained toner particle 1 (100 parts) by using FM10C (manufactured by Nippon Coke & Engineering Co., Ltd.).

External addition conditions were as follows. Charge amount of toner particles: 1.5 kg, rotation speed: 50.0 $s^{-1}$, external addition time: 10 min, and the temperature and flow rate of cooling water: 22.0° C. and 10 L/min, respectively. A toner 1 was then obtained by sieving with a mesh having an opening of 200 μm.

The production conditions and external addition conditions of the toner 1 are shown in Table 3. The physical properties of the toner are shown in Table 4.

Production Examples of Toners 2 to 25

Toners 2 to 25 were obtained in the same manner as in Production Example of Toner 1 except that the type of toner particles and the type of metal titanate fine particles were changed to those in Table 3.

The physical properties of the toner are shown in Table 4.

TABLE 3

| Toner particle | | | | External fine particle | | External addition conditions | | |
|---|---|---|---|---|---|---|---|---|
| Toner No. | Toner particle No. | Type of wax | Amount of wax (parts by mass) | Strontium titanate | Parts | Charge amount (kg) | Rotation speed ($s^{-1}$) | External addition time (min) |
| 1 | 1 | A1 | 15 | T1 | 0.7 | 1.5 | 50.0 | 10 |
| 2 | 2 | A2 | 15 | T1 | 0.7 | 1.5 | 50.0 | 10 |
| 3 | 3 | A1 | 15 | T1 | 0.7 | 1.5 | 50.0 | 10 |
| 4 | 1 | A1 | 15 | T2 | 0.7 | 1.5 | 50.0 | 10 |
| 5 | 1 | A1 | 15 | T3 | 0.7 | 1.5 | 50.0 | 10 |
| 6 | 4 | A1 | 15 | T4 | 0.7 | 1.5 | 50.0 | 10 |
| 7 | 5 | A1 | 15 | T4 | 0.7 | 1.5 | 50.0 | 10 |
| 8 | 6 | A1 | 15 | T4 | 0.7 | 1.5 | 50.0 | 10 |
| 9 | 7 | A1 | 15 | T4 | 0.7 | 1.5 | 50.0 | 10 |
| 10 | 8 | A1 | 3 | T4 | 0.8 | 1.5 | 50.0 | 10 |
| 11 | 9 | A1 | 4 | T4 | 1.6 | 1.5 | 50.0 | 10 |
| 12 | 10 | A3 | 15 | T4 | 0.4 | 1.5 | 50.0 | 10 |
| 13 | 1 | A1 | 15 | T5 | 0.7 | 1.5 | 50.0 | 10 |
| 14 | 1 | A1 | 15 | T6 | 0.7 | 1.5 | 50.0 | 10 |
| 15 | 1 | A1 | 15 | T7 | 0.7 | 1.5 | 50.0 | 10 |
| 16 | 11 | A1 | 15 | T4 | 0.7 | 1.5 | 50.0 | 10 |
| 17 | 12 | A2 | 15 | T4 | 0.7 | 1.5 | 50.0 | 10 |
| 18 | 13 | A2 | 15 | T4 | 0.7 | 1.5 | 50.0 | 10 |
| 19 | 14 | A4 | 15 | T4 | 0.7 | 1.5 | 50.0 | 10 |
| 20 | 15 | A3 | 15 | T4 | 0.7 | 1.5 | 50.0 | 10 |
| 21 | 1 | A1 | 15 | T8 | 0.7 | 1.5 | 50.0 | 10 |
| 22 | 1 | A1 | 15 | T9 | 0.7 | 1.5 | 50.0 | 10 |
| 23 | 1 | A1 | 15 | T10 | 0.7 | 1.5 | 50.0 | 10 |
| 24 | 1 | A1 | 15 | Not added | | 1.5 | 50.0 | 10 |
| 25 | 12 | A1 | 15 | T10 | 1.0 | 1.5 | 50.0 | 10 |

TABLE 4

| Toner | Toner composition X (% by mass) | Toner composition Y (% by mass) | Toner composition X/Y | Physical properties of toner D4 (μm) | Physical properties of toner As (%) | Physical properties of toner Glass transition temperature (° C.) |
|---|---|---|---|---|---|---|
| Toner 1 | 10.9 | 0.7 | 15.6 | 6.5 | 17.5 | 56.5 |
| Toner 2 | 10.9 | 0.7 | 15.6 | 5.8 | 5.3 | 57.8 |
| Toner 3 | 10.9 | 0.7 | 15.6 | 6.5 | 29.2 | 56.1 |
| Toner 4 | 10.9 | 0.7 | 15.6 | 6.5 | 17.5 | 56.5 |
| Toner 5 | 10.9 | 0.7 | 15.6 | 6.5 | 17.5 | 56.5 |
| Toner 6 | 10.9 | 0.7 | 15.6 | 4.4 | 17.5 | 56.5 |
| Toner 7 | 10.9 | 0.7 | 15.6 | 3.9 | 19.8 | 56.5 |
| Toner 8 | 10.9 | 0.7 | 15.6 | 9.8 | 20.5 | 56.5 |
| Toner 9 | 2.4 | 0.7 | 3.4 | 10.3 | 10.3 | 56.5 |
| Toner 10 | 2.8 | 0.8 | 3.5 | 6.5 | 9.7 | 56.3 |
| Toner 11 | 10.9 | 1.5 | 7.3 | 6.5 | 7.1 | 56.3 |
| Toner 12 | 10.9 | 0.4 | 27.3 | 6.5 | 21.2 | 55.8 |
| Toner 13 | 10.9 | 0.7 | 15.6 | 6.5 | 17.5 | 56.5 |
| Toner 14 | 10.9 | 0.7 | 15.6 | 6.5 | 17.5 | 56.5 |
| Toner 15 | 10.9 | 0.7 | 15.6 | 6.5 | 17.5 | 56.5 |
| Toner 16 | 8.0 | 0.7 | 11.4 | 6.0 | 14.1 | 56.7 |
| Toner 17 | 8.0 | 0.7 | 11.4 | 6.0 | 11.1 | 58 |
| Toner 18 | 10.9 | 0.7 | 15.6 | 5.8 | 0.5 | 57.5 |
| Toner 19 | 10.9 | 0.7 | 15.6 | 6.5 | 4.8 | 57.9 |
| Toner 20 | 10.9 | 0.7 | 15.6 | 6.5 | 30.5 | 56.8 |
| Toner 21 | 10.9 | 0.7 | 15.6 | 6.5 | 17.5 | 56.5 |
| Toner 22 | 10.9 | 0.7 | 15.6 | 6.5 | 17.5 | 56.5 |
| Toner 23 | 10.9 | 0.7 | 15.6 | 6.5 | 17.5 | 56.5 |
| Toner 24 | 10.9 | — | — | 6.5 | 17.5 | 56.5 |
| Toner 25 | 8.0 | 0.7 | 11.4 | 6.0 | 14.1 | 56.3 |

For each of the obtained toners, performance evaluation was carried out according to the following methods.

Low-temperature Fixability

A color laser printer (HP LaserJet Enterprise Color M553dn, manufactured by HP Corp.) from which the fixing unit was removed was prepared, the toner was taken out from the cyan cartridge, and instead the toner to be evaluated was filled therein. Next, an unfixed toner image having a length of 2.0 cm and a width of 15.0 cm (toner laid-on level: 0.6 mg/cm$^2$) was formed using the filled toner in a portion at 1.0 cm from the upper end in the sheet passing direction on paper (HP Laser Jet 90, manufactured by HP Corp., 90 g/m$^2$). Subsequently, the removed fixing unit was modified so that the fixation temperature and the process speed could be adjusted, and the fixing test of the unfixed image was carried out using the modified fixing unit.

First, under the normal-temperature and normal-humidity environment (23° C., 60% RH), the process speed was set to 350 mm/s, the fixing line pressure was set to 27.4 kgf, the initial temperature was set to 110° C., the temperature was sequentially raised by 5° C., and the unfixed image was fixed at each temperature.

Evaluation criteria for low-temperature fixability are presented below. The low-temperature-side fixing onset temperature is a lower limit temperature at which a low-temperature offset phenomenon (a phenomenon that a part of the toner adheres to the fixing unit) is not observed.

Evaluation results are shown in Table 5.

Evaluation Criteria

A: low-temperature-side fixing onset temperature is less than 160° C.

B: low-temperature-side fixing onset temperature is from 160° C. to less than 175° C.

C: low-temperature-side fixing onset temperature is from 175° C. to less than 200° C.

D: low-temperature-side fixing onset temperature is 200° C. or more

Evaluation of Fixing Separability

A color laser printer (HP LaserJet Enterprise Color M553dn, manufactured by HP Corp.) from which the fixing unit was removed was prepared, the toner was taken out from the cyan cartridge, and instead the toner to be evaluated was filled therein. Paper (HP Laser Jet 90, manufactured by HP Corp., 90 g/m$^2$) was used as a recording medium.

Next, an unfixed toner image having a length of 5.0 cm and a width of 20.0 cm was formed using the filled toner to a toner laid-on level of 0.90 mg/cm$^2$, while changing the length of the margin portion from the upper end with respect to the sheet passing direction.

Subsequently, the removed fixing unit was modified so that the fixation temperature and the process speed could be adjusted, and the fixing test of the unfixed image was carried out using the modified fixing unit.

First, under the normal-temperature and normal-humidity environment (23° C., 60% RH), the process speed was set to 350 mm/s, the fixing line pressure was set to 27.4 kgf, and the unfixed image was fixed at a set temperature of 200° C. The smallest margin at which the paper did not wind around the fixing roller was evaluated according to the following criteria.

Evaluation results are shown in Table 5.

Evaluation Criteria

A: margin from the upper end is less than 1 mm

B: margin from the upper end is from 1 mm to less than 3 mm

C: margin from the upper end is from 3 mm to less than 5 mm

D: margin from the upper end is 5 mm or more

Evaluation of Ejected Paper Adhesion

The evaluation was carried out using a modified HP LaserJet Enterprise Color M553dn, (manufactured by HP Corp.) as a color laser printer. The details of modification are as follows.

By changing the gear and software of the evaluation machine main body, the process speed was made 350 mm/sec.

A cyan cartridge was used as a cartridge for evaluation. That is, the product toner was taken out from a commercially available cyan cartridge and the interior thereof was cleaned by air blowing. Then, 50 g of the toner 1 was filled. In each of the magenta, yellow and black stations, the respective product toner was removed, and magenta, yellow and black cartridges in which the toner remaining amount detection mechanism was deactivated were inserted.

Under the above conditions, images of 25.0 cm in length and 20.0 cm in width were printed in a continuous mode so as to obtain a toner laid-on level of 0.45 mg/cm$^2$, and the evaluation was carried out while changing the number of sheets stacked.

After a predetermined number of printed sheets were ejected to the discharge tray, the sheets were allowed to stand for 1 min, and then toner contamination on the stacked paper was evaluated according to the following criteria.

Evaluation results are shown in Table 5.

Evaluation Criteria

A: no toner contamination on paper in a stack of 250 sheets

B: toner contamination on paper occurs in a stack including from 150 to less than 250 sheets C: toner contamination on paper occurs in a stack including from 50 to less than 150 sheets D: toner contamination on paper occurs in a stack including less than 50 sheets Evaluation of Development Stripes (Durability) Under Low-Temperature and Low-Humidity Environment The evaluation was carried out using a modified HP LaserJet Enterprise Color M553dn, (manufactured by HP Corp.) as a color laser printer.

A cyan cartridge was used as a cartridge for evaluation. That is, the product toner was taken out from a commercially available cyan cartridge and the interior thereof was cleaned by air blowing. Then, the toner to be evaluated (100 g) was filled.

The evaluation was performed under a low-temperature and low-humidity environment (15° C./10% RH).

XEROX 4200 paper (manufactured by XEROX Co., 75 g/m$^2$) was used as evaluation paper.

Intermittent durability printing was implemented with respect to 15,000 prints by outputting two E character images at a print percentage of 1% every 4 seconds under a low-temperature and low-humidity environment.

The toner coatability and solid image on the developer carrying member were visually observed and determined by the following indicators. Evaluation results are shown in Table 5.

A: no stripe on the developer carrying member

B: a stripe is visible on the developer carrying member, but the stripe cannot be seen in the solid image C: minor stripes can be seen on the solid image D: clear stripes on the solid image

TABLE 5

| | | Low-temperature fixability | | | | Ejected paper adhesion | | |
|---|---|---|---|---|---|---|---|---|
| | | | Fixing onset | Separability | | | Number of | |
| | Toner No. | Evaluation | temperature (° C.) | Evaluation | Margin (mm) | Evaluation | sheets (sheet) | Durability Evaluation |
| Example 1 | 1 | A | 155 | A | 0.8 | A | 250 | A |
| Example 2 | 2 | C | 185 | C | 3.2 | A | 250 | A |
| Example 3 | 3 | A | 145 | A | 0.2 | B | 175 | C |
| Example 4 | 4 | A | 155 | A | 0.8 | C | 100 | A |
| Example 5 | 5 | A | 155 | A | 0.8 | C | 100 | A |
| Example 6 | 6 | A | 150 | A | 0.6 | A | 250 | B |
| Example 7 | 7 | A | 150 | A | 0.4 | A | 250 | C |
| Example 8 | 8 | B | 170 | B | 2.2 | A | 250 | A |
| Example 9 | 9 | C | 175 | B | 1.8 | A | 250 | A |
| Example 10 | 10 | C | 180 | C | 4.6 | A | 250 | A |
| Example 11 | 11 | B | 170 | B | 2.4 | A | 250 | A |
| Example 12 | 12 | A | 150 | A | 0.4 | C | 100 | A |
| Example 13 | 13 | A | 155 | A | 0.8 | C | 75 | B |
| Example 14 | 14 | A | 155 | A | 0.8 | B | 200 | B |
| Example 15 | 15 | A | 155 | A | 0.8 | C | 125 | B |
| Example 16 | 16 | B | 160 | B | 1.4 | A | 250 | A |
| Example 17 | 17 | B | 170 | B | 1.8 | A | 250 | A |
| Comparative Example 1 | 18 | D | 200 | D | 6.0 | A | 250 | A |
| Comparative Example 2 | 19 | C | 185 | D | 5.0 | A | 250 | A |
| Comparative Example 3 | 20 | A | 145 | A | 0.2 | C | 125 | D |
| Comparative Example 4 | 21 | A | 155 | A | 0.8 | D | 25 | B |
| Comparative Example 5 | 22 | A | 155 | A | 0.8 | D | 25 | B |
| Comparative Example 6 | 23 | A | 155 | A | 0.8 | D | 25 | B |
| Comparative Example 7 | 24 | A | 155 | A | 0.8 | D | 10 | B |
| Comparative Example 8 | 25 | A | 155 | B | 1.4 | D | 25 | B |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-086035, filed Apr. 27, 2018, Japanese Patent Application No. 2019-032501, filed Feb. 26, 2019, which are hereby incorporated by reference herein in their entirety.

What is claimed is:

1. A toner comprising a toner particle having a binder resin, a wax and a colorant, and metal titanate fine particles each having a perovskite crystal structure, the metal titanate fine particles each having the perovskite crystal structure being strontium titanate particles, a number average particle diameter of primary particles of the metal titanate fine particles being 10 to 80 nm, wherein As is 5.0 to 30.0% where As is a proportion of an area occupied by the wax in a surface layer region from the surface of the toner particle to a depth of 1.0 μm in cross section observation of the toner using a transmission electron microscope, peaks derived from the strontium titanate particles are at 39.700°±0.150° and 46.200°±0.150° in an X-ray diffraction spectrum of CuKα obtained in the range of 2θ of from 10° to 90°, with θ being a Bragg angle of the strontium titanate fine particles; and Sb/Sa is 1.80 to 2.30 when Sa is an area of the peak at 39.700°±0.150° and Sb is an area of the peak at 46.200°±0.150°.

2. The toner according to claim 1, wherein the toner has a weight average particle diameter of 4.0 to 10.0 μm.

3. The toner according to claim 1, wherein X is 3.0 or more and X/Y is 2.0 to 20.0 when an amount of the wax is denoted by X % by mass, and an amount of the metal titanate fine particles is denoted by Y % by mass based on a total mass of the toner.

4. The toner according to claim 1, wherein the wax includes an ester wax.

5. The toner according to claim 4, wherein the ester wax is represented by formula (2) or formula (3)

(2)

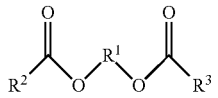

(3)

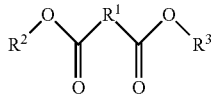

where $R^1$ represents an alkylene group having from 1 to 12 carbon atoms, and $R^2$ and $R^3$ independently represent a linear alkyl group having from 11 to 25 carbon atoms.

* * * * *